US011211746B2

(12) United States Patent
Jung et al.

(10) Patent No.: US 11,211,746 B2
(45) Date of Patent: Dec. 28, 2021

(54) ELECTRICAL CONNECTOR WITH PROTRUDING PORTIONS ON A CENTRAL TONGUE PLATE

(71) Applicant: Samsung Electronics Co., Ltd., Gyeonggi-do (KR)

(72) Inventors: Waneui Jung, Gyeonggi-do (KR); Jaeryong Han, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/958,216

(22) PCT Filed: Jan. 18, 2019

(86) PCT No.: PCT/KR2019/000729
§ 371 (c)(1),
(2) Date: Jun. 26, 2020

(87) PCT Pub. No.: WO2019/143160
PCT Pub. Date: Jul. 25, 2019

(65) Prior Publication Data

US 2021/0075155 A1 Mar. 11, 2021

(30) Foreign Application Priority Data

Jan. 19, 2018 (KR) ..... 10-2018-0006960

(51) Int. Cl.
*H01R 13/629* (2006.01)
*H01R 12/71* (2011.01)
(Continued)

(52) U.S. Cl.
CPC ..... *H01R 13/629* (2013.01); *H01R 12/716* (2013.01); *H01R 24/60* (2013.01);
(Continued)

(58) Field of Classification Search
CPC ..... H01R 2107/00; H01R 12/7076; H01R 13/6581; H01R 13/658; H01R 13/648;
(Continued)

(56) References Cited

U.S. PATENT DOCUMENTS

2004/0242070 A1 12/2004 Inoue et al.
2016/0172790 A1 6/2016 Chen et al.
(Continued)

FOREIGN PATENT DOCUMENTS

JP 2015-56244 A 3/2015
KR 10-2004-0103322 A 12/2004
(Continued)

*Primary Examiner* — Abdullah A Riyami
*Assistant Examiner* — Justin M Kratt
(74) *Attorney, Agent, or Firm* — Cha & Reiter, LLC

(57) ABSTRACT

An electronic device according to an embodiment of the present invention includes a processor and a socket connector, wherein the socket connector includes: a housing including a first opening, a second opening, and an inner space between the first opening and the second opening; and a connection unit coupled to the first opening, wherein the connection unit has a top surface on which one or more first terminals electrically connected to the processor are disposed, and a bottom surface on which one or more second terminals electrically connected to the processor are disposed, and includes a first plate formed of a non-conductive member in at least a portion of an area of the inner space, and a second plate disposed between at least a portion of the top surface and at least a portion of the bottom surface, wherein the second plate has a portion protruding from the one or more first terminals or the one or more second terminals in the direction of the second opening into which a header connector can be inserted, and at least a portion of the protruding portion can be bent in the direction of at least one of the top surface or the bottom surface. Various other embodiments are possible.

15 Claims, 27 Drawing Sheets

(51) Int. Cl.

| | |
|---|---|
| ***H01R 24/60*** | (2011.01) |
| *H01R 12/72* | (2011.01) |
| *H01R 13/658* | (2011.01) |
| *H01R 13/648* | (2006.01) |
| *H01R 13/6585* | (2011.01) |
| *H01R 13/6581* | (2011.01) |
| *H01R 107/00* | (2006.01) |
| *H01R 12/70* | (2011.01) |

(52) U.S. Cl.
CPC ..... *H01R 12/7076* (2013.01); *H01R 12/71* (2013.01); *H01R 12/722* (2013.01); *H01R 12/724* (2013.01); *H01R 13/648* (2013.01); *H01R 13/658* (2013.01); *H01R 13/6581* (2013.01); *H01R 13/6585* (2013.01); *H01R 2107/00* (2013.01); *H01R 2201/06* (2013.01)

(58) Field of Classification Search
CPC .... H01R 13/629; H01R 12/716; H01R 24/60; H01R 12/724; H01R 12/71; H01R 13/6585; H01R 2201/06; H01R 12/722
USPC ..... 439/660, 676
See application file for complete search history.

(56) References Cited

U.S. PATENT DOCUMENTS

| | | | | |
|---|---|---|---|---|
| 2016/0322759 | A1* | 11/2016 | Park ..... | H01R 13/6585 |
| 2017/0237202 | A1 | 8/2017 | Gao et al. | |

FOREIGN PATENT DOCUMENTS

| | | | |
|---|---|---|---|
| KR | 20-0479847 | Y1 | 3/2016 |
| KR | 10-2016-0128828 | A | 11/2016 |
| KR | 20-2017-0002764 | U | 8/2017 |

* cited by examiner

ELECTRICAL CONNECTOR WITH PROTRUDING PORTIONS ON A CENTRAL TONGUE PLATE

CROSS-REFERENCE TO RELATED APPLICATION(S)

This application is a National Phase Entry of PCT International Application No. PCT/KR2019/000729, which was filed on Jan. 18, 2019, and claims priority to Korean Patent Application No. 10-2018-0006960, which was filed on Jan. 19, 2018, the contents of which are incorporated herein by reference.

TECHNICAL FIELD

Various embodiments of the disclosure relate to a connector and an electronic device including the same.

BACKGROUND ART

With the development of digital technology, electronic devices are provided in various forms such as a smartphone, a tablet personal computer (PC), and a personal digital assistant (PDA). In order to improve portability and user accessibility, electronic devices are also being developed in a form that can be worn by a user. An electronic device may include various interfaces for exchanging signals with an external electronic device. For example, an electronic device may provide an interface based on wired communication, such as a universal serial bus (USB), and may include a socket connector for supporting the interface.

DISCLOSURE OF INVENTION

Technical Problem

When a header connector is frequently inserted into or removed from the socket connector, fatigue of the socket connector may be increased and damage to the socket connector may be caused. In addition, the socket connector may also be damaged when an inappropriate header connector is inserted into the socket connector due to lack of recognition regarding the type of the socket connector. For example, when an external object is inserted into the socket connector, a structure in which a plurality of conductive terminals for electrical connection to the header connector are arranged may be damaged by a shock or load applied by the external object, or the conductive terminals may be removed from the structure or may be deformed.

Various embodiments of the disclosure are capable of providing a socket connector that is prevented from being damaged by an external object inserted thereinto, and an electronic device including the same.

Solution to Problem

An electronic device according to an embodiment of the disclosure may include a processor and a socket connector, and the socket connector may include a housing including a first opening, a second opening, and an inner space between the first opening and the second opening, and a connection part coupled to the first opening. The connection part may include: a first plate including a top surface on which one or more first terminals electrically connected to the processor are disposed and a bottom surface on which one or more second terminals electrically connected to the processor are disposed, the first plate being formed as a non-conductive member in at least a partial region of the inner space; and a second plate disposed between at least a portion of the top surface and at least a portion of the bottom surface. The second plate may include a portion protruding further than the one or more first terminals or the one or more second terminals toward the second opening into which a header connector is capable of being inserted, and at least a portion of the protruding portion may be bent toward at least one of the top surface and the bottom surface.

Advantageous Effects of Invention

A socket connector according to various embodiments of the disclosure includes a second plate disposed inside a non-conductive first plate in which a plurality of terminals are disposed, and the second plate protrudes further than the terminals toward the opening in the socket connector into which the header connector can be inserted, and is designed in a form bent toward the top surface or the bottom surface of the first plate. Therefore, the bent end portion of the conductive second plate is capable of preventing the non-conductive first plate and/or the terminals from being damaged by an external object inserted into the socket connector.

BEST MODE FOR CARRYING OUT THE INVENTION

Figure 1A:
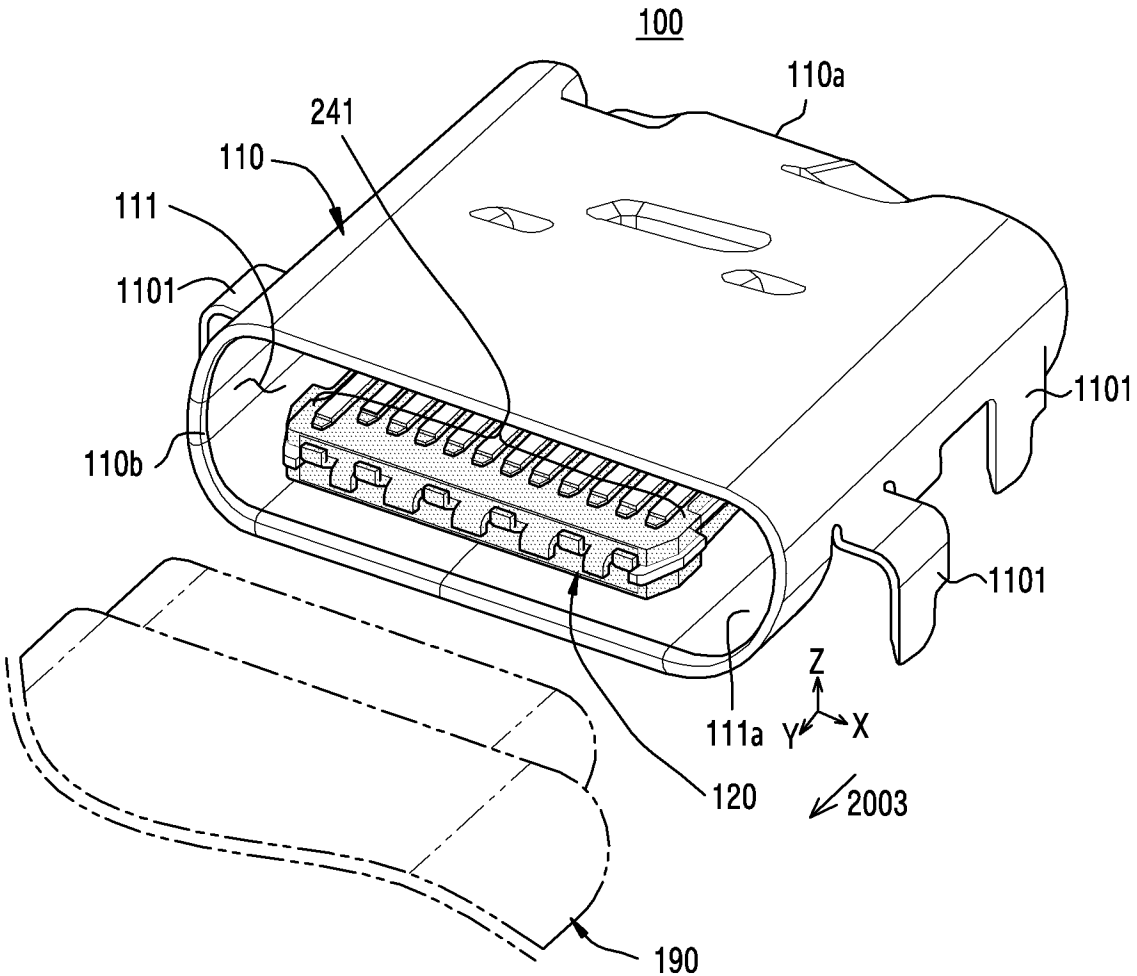
FIG. 1A is a perspective view of a socket connector according to an embodiment.

Hereinafter, various embodiments of the present disclosure will be described with reference to the accompanying drawings. The examples and terms used herein are not intended to limit the techniques described in this document to specific embodiments, but should be understood to include various modifications, equivalents, and/or alternatives to the examples. In connection with the description of the drawings, similar reference numerals may be used for similar components. Singular expressions may include plural expressions unless the context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. The expressions "a first", "a second", "the first", "the second", and the like as used in various embodiments may modify various elements regardless of the order and/or the importance thereof. These expressions may be used merely to distinguish between one element and any other element, and do not limit the corresponding elements. When an element (e.g., first element) is referred to as being (operatively or communicatively) "connected," or "coupled," to another element (e.g., second element), it may be directly connected or coupled directly to the other element or any other element (e.g., third element) may be interposer between them.

The expression "configured to" used in the disclosure may be interchangeably used with, for example, "suitable for", "having the capacity to", "designed to", "adapted to", "made to", or "capable of" according to the situation. The term "configured to" may not necessarily imply "specifically designed to" in hardware. Alternatively, in some situations, the expression "device configured to" may mean that the device, together with other devices or components, "is able to".

Figure 1B:
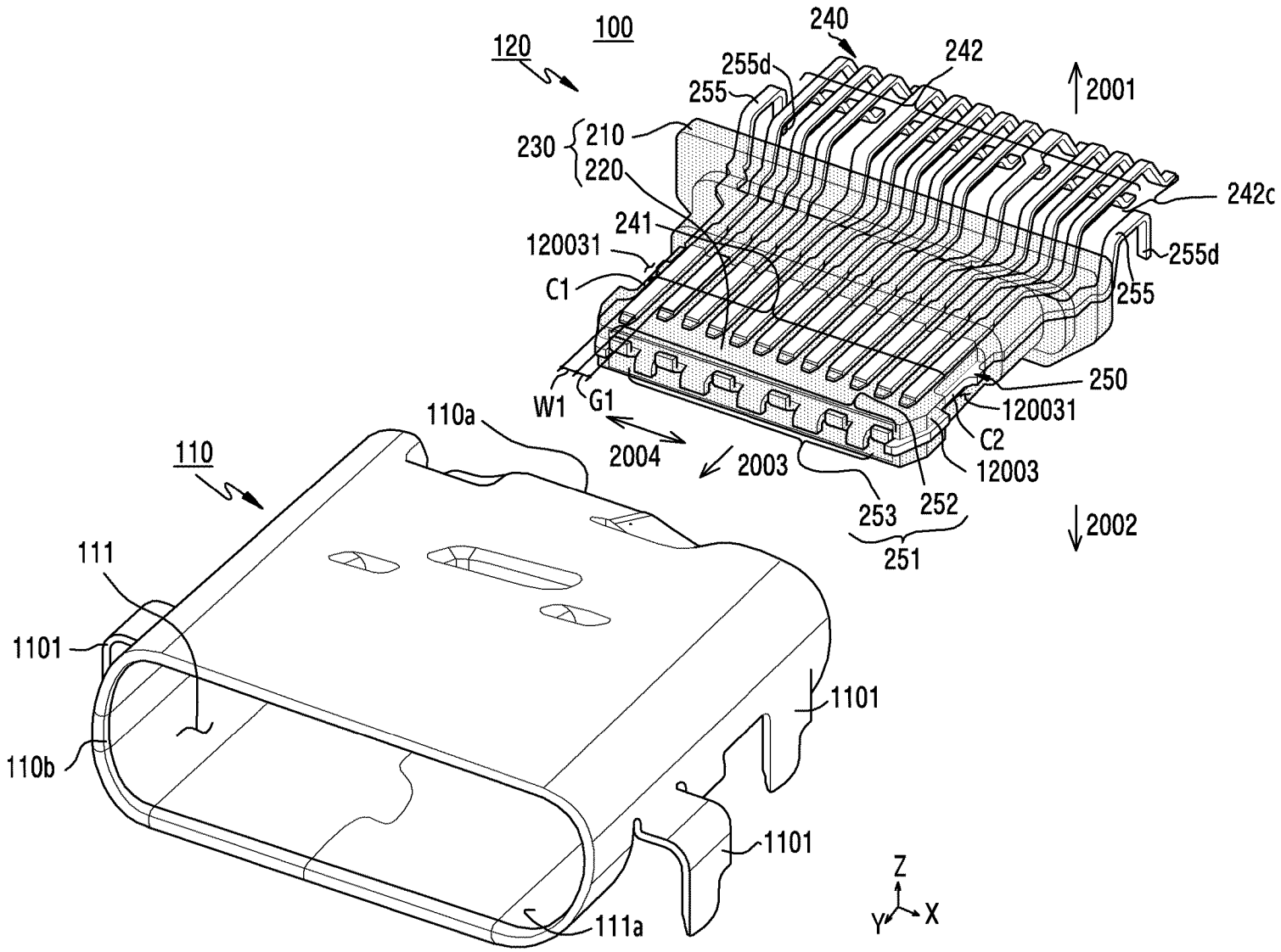
FIG. 1B is an exploded perspective view of the socket connector of FIG. 1A.
Figure 1C:
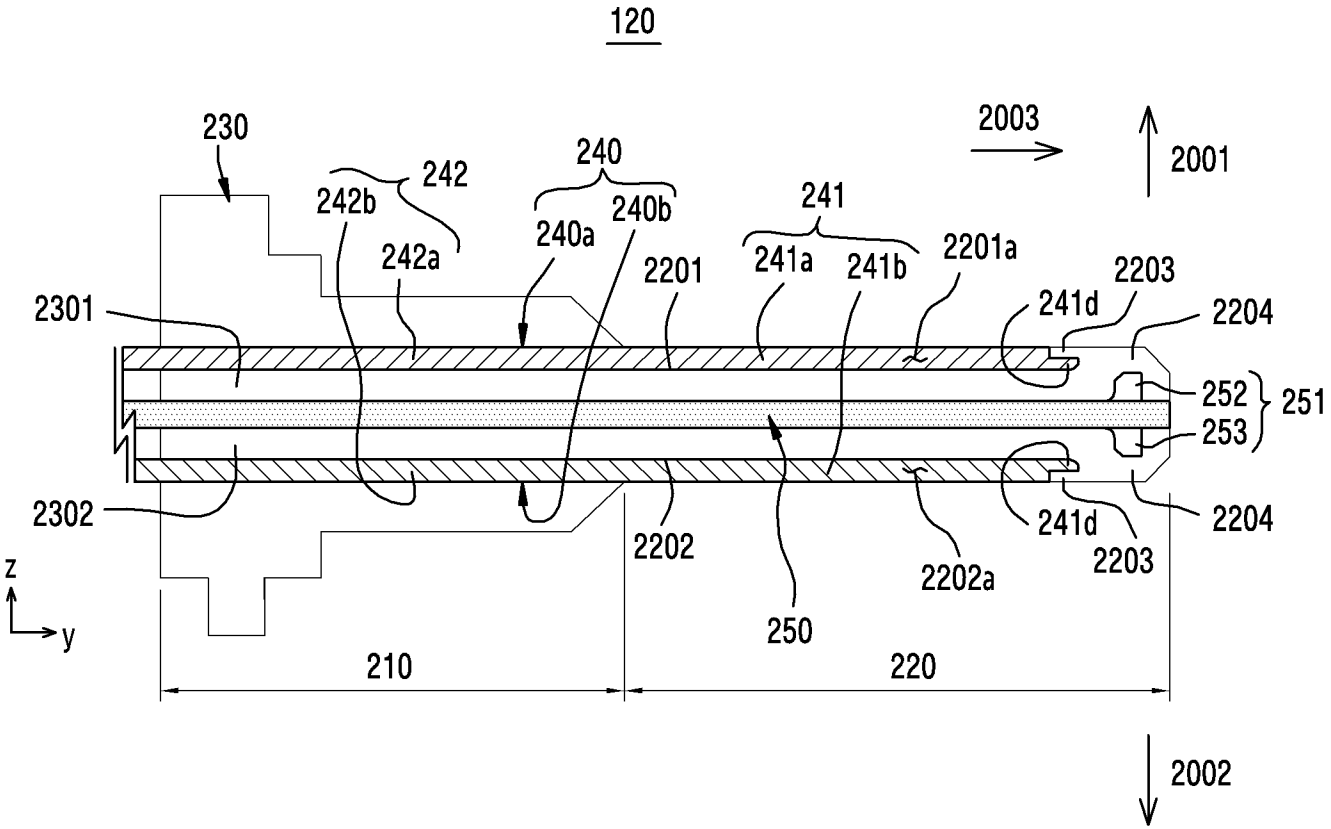
FIG. 1C is a cross-sectional view of a connection part included in the socket connector according to the embodiment.
Figure 1D:
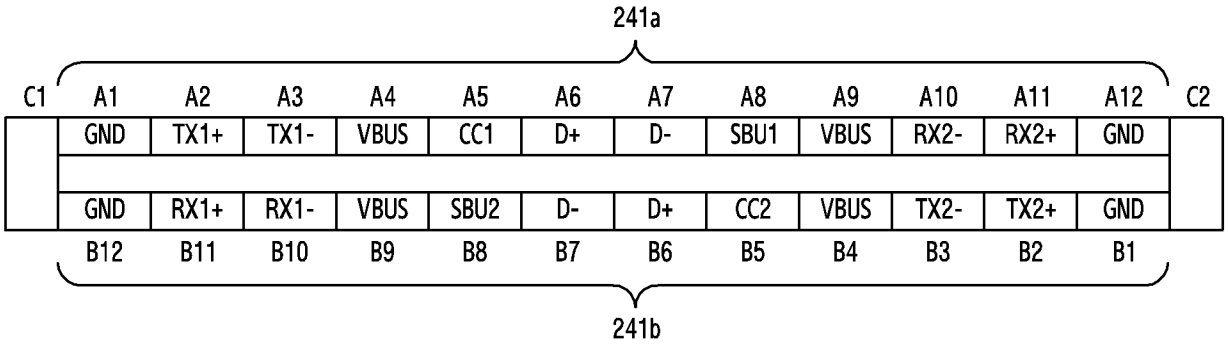
FIG. 1D is a map of an arrangement of terminals of a socket connector according to the embodiment.

FIG. 1A is a perspective view of a socket connector according to an embodiment. FIG. 1B is an exploded perspective view of the socket connector of FIG. 1A. FIG. 1C is a cross-sectional view of a connection part included in the socket connector according to the embodiment. FIG. 1D is a map of an arrangement of terminals of a socket connector according to the embodiment.

Referring to FIGS. 1A and 1B, a socket connector (or a receptacle) 100 may include a housing (or a shell) 110 and a connection part 120 coupled to the housing 110. The housing 110 may include a first opening 110*a*, a second opening 110*b*, and an inner space 111 between the first opening 110*a* and the second opening 110*b*. When a header connector (or a plug) 190 is inserted into the inner space 111 through the second opening 110*b*, a plurality of terminals 241 disposed in the connection part 120 may be electrically connected to the header connector 190. The inner space 111 may be designed in a shape for guiding the movement of the header connector 190.

The housing 110 is formed of a conductive material, such as stainless steel or phosphor bronze, and may be electrically connected to a printed circuit board (PCB) (not shown) on which the socket connector 100 is mounted.

The housing 110 includes a plurality of leads 1101 extending therefrom, and the plurality of leads 1101 may be coupled to the printed circuit board using soldering.

The connection part (or a tongue) 120 may include a base 210 coupled to the first opening 110*a* in the housing 110. The first opening 110*a* may be designed to have an inner structure to which the base 210 can be fitted. The connection part 120 may include a first plate 220 in the form of a cantilever extending in a separation direction in which the header connector is removed from the base 210 (hereinafter, referred to as a "third direction 2003"). The cantilever may be defined as a member which is fixed at one end and is free at the other end. The first plate 220 may be separated from the inner surface 111*a* of the housing 110 that defines the inner space 111, and may not protrude to the outside of the second opening 110*b*. According to some embodiments, the first plate 220 may be designed to protrude to the outside of the second opening 110*b*. The base 210 and the first plate 220 may be designed as an integral support member 230 formed of a non-conductive material such as glass-filled nylon. According to some embodiments, the base 210 and the first plate 220 may be formed of different non-conductive materials. In FIGS. 1A and 1B, the support member 230 is transparently expressed for structural understanding of the support member 230 and elements coupled thereto.

Referring to FIGS. 1B and 1C, the connection part 120 may include a plurality of conductive patterns 240 coupled to the support member 230. The plurality of conductive patterns 240 are physically separated from each other by being disposed at different positions on the support member 230, and may include a plurality of terminals (or contacts or pins) 241 disposed on the first plate 220 and a plurality of leads 242 extending from the plurality of terminals 241 and passing through the base 210. According to an embodiment, the base 210 may be formed in a shape thicker than the first plate 220 to cover the plurality of leads 242 extending from the plurality of terminals 241. The plurality of terminals 241 may be prevented from being lifted or separated from the first plate 220 by being supported by the plurality of leads 242 fixed to the base 210.

The plurality of terminals 241 may have a thin plate shape having a length extending in the third direction 2003, and may be arranged in a fourth direction 2004 orthogonal to the third direction 2003. Some terminals may be designed to protrude further than or not to protrude further than other terminals in the third direction 2003. According to some embodiments, the sizes (e.g., the width) W1 of some terminals in the fourth direction 2004 may be designed to be equal to or different from each other. According to some embodiments, the gap G1 between the plurality of terminals 241 may be designed to be constant or non-constant.

According to an embodiment, the socket connector 100 may be a type-C socket connector or a reversible socket connector that enables a type-C header connector to be connected thereto without distinction between the top and bottom sides. The first plate 220 may include a top surface 2201 oriented in a first direction 2001 and a bottom surface 2202 oriented in a second direction 2002 opposite the first direction 2001. The plurality of terminals 241 may include first terminals 241*a* disposed on the top surface 2201 and second terminals 241*b* disposed on the bottom surface 2202. Further referring to FIG. 1D, the first terminals 241*a* may include a ground terminal A1, terminals A2, A3, A10, and A11 for supporting high-speed data transmission, and terminals A4 and A9 for supporting power supply, a channel configuration (CC) terminal A5, a sideband use (SBU) terminal A8, and terminals A6 and A7 for supporting low-speed data transmission. The second terminals 241*b* may include terminals for the same function as the first terminals 241*a*, that is, a ground terminal B1, terminals B2, B3, B10, and B11 for supporting high-speed data transmission, terminals B4 and B9 for supporting power supply, a CC terminal B5, an SBU terminal B8, and terminals B6 and B7 for supporting low-speed data transmission. The second terminals 241*b* may be arranged opposite the first terminals 241*a*. According to an embodiment, the socket connector 100 may support a universal serial bus (USB) 2.x, 3.x, or more communication protocol.

Referring to FIG. 1C, in an embodiment, the top surface 2201 may include grooves 2201*a* in a shape recessed in the second direction 2002, and the first terminals 241*a* may be disposed in the grooves 2201*a*, respectively. The bottom surface 2202 includes grooves 2202*a* in a shape recessed in the first direction 2201, and the second terminals 241*b* may be disposed in the grooves 2202*a*, respectively. According to an embodiment, end portions of the plurality of terminals 241 may include lips 241*d* in a shape protruding in the third direction 2003, and a portion 2203 of the first plate 220 may be adapted to cover the lips 241*d* so as to prevent the plurality of terminals 241 from being lifted or separated from the first plate 220. According to some embodiments, the plurality of terminals 241 may further include lips protruding in the fourth direction 2004, and may be designed in a structure in which a portion of the first plate 220 covers the lips. According to some embodiments, an adhesive layer may be disposed between the plurality of terminals 241 and the first plate 220. The first terminals 241*a* may not protrude with respect to the first plate 220 in the first direction 2001, and the second terminals 241*b* may not protrude with respect to the first plate 220 in the second direction 2002. According to some embodiments, the first terminals 241*a* may be designed to protrude with respect to the first plate 220 in the first direction 2001, and the second terminals 241*b* may be designed to protrude with respect to the first plate 220 in the second direction 2002. The surfaces of the first terminals 241*a* exposed in the first direction 2001 and the surfaces of the second terminals 241*b* exposed in the second direction 2002 may come into electrical contact with the terminals of a header connector (e.g., the header connector 190 in FIG. 1A) coupled to the socket connector 100.

Referring to FIGS. 1B and 1C, the connection part 120 may include a second plate 250 disposed between at least a portion of the top surface 2201 of the first plate 220 and at least a portion of the bottom surface 2202 of the first plate 220. The second plate 250 may have a shape extending to the inside of the base 210. According to an embodiment, the second plate 250 may be designed to have a strength (e.g., tensile strength, flexural strength, shear strength, compressive strength, fatigue strength, or the like) greater than that of the first plate 220 so as to increase the endurance (or mechanical strength) of the connection part 120. The conductive patterns 240 include first conductive patterns 240*a* including first terminals 241*a* and first leads 242*a* extending from the first terminals 241*a*, and second conductive patterns 240*b* including second terminals 241*b* and second leads 242*b* extending from the second terminals 241*b*. In the connection part 120, the second plate 250 may be disposed between the first conductive patterns 240*a* and the second conductive patterns 240*b*. The support member 230 may include a portion 2301 disposed between the second plate 250 and the first conductive patterns 240*a* and a portion 2302 disposed between the second plate 250 and the second conductive patterns 240*b*, whereby the second plate 250 may be physically separated from the first and second conductive patterns 240*a* and 240*b*. Tails 242*c* of the plurality of leads 242 (e.g., the first and second leads 242*a* and 242*b*) may be coupled to lands (or copper foil pads) on a printed circuit board (not illustrated) mounted in an electronic device using soldering.

According to an embodiment, the second plate 250 is formed of a conductive material, and may be electrically connected to the printed circuit board. The connection part 120 includes leads 255 extending to the outside of the support member 230 from the second plate 250, and the tails 255*d* of the leads 255 may be coupled to lands on a printed circuit board (not illustrated) mounted in an electronic device using soldering. According to an embodiment, the second plate 250 may be electrically connected to a ground of a printed circuit board.

The second plate 250 may include portions exposed to opposite side surfaces 12003 of the first plate 220 or protruding with respect to the opposite side surfaces 12003 of the first plate 220, and these portions may be used as terminals (hereinafter, referred to as "C terminals") C1 and C2 electrically connected to a header connector (e.g., 190 in FIG. 1A). On opposite side surfaces 12003 of the connection part 120, hook fastening portions 120031 for snap-fit fastening with terminals including hooks of the header connector (e.g., the header connector 190 in FIG. 1A) may be provided. The terminals (not illustrated) including the hooks of the header connector (e.g., the header connector 190 in FIG. 1A) may be fastened to the hook fastening portions 120031 of the connection part 120, and may be electrically connected to the C terminals C1 and C2.

In an embodiment, the second plate 250 may include a portion 251 that protrudes further than the first terminals 241*a* or the second terminals 241*b* in the third direction 2003, and this protruding portion 251 may be bent in the first direction 2001 or the second direction 2002. The bent end portion 251 may prevent the first plate 220 and/or the plurality of terminals 241 from being damaged due to an external object (e.g., the header connector 190 in FIG. 1A) inserted into the socket connector 100. For example, assuming that the bent end portion 251 of the second plate 250 is not designed in the structure of FIG. 1C, when an external object, such as a header connector, is inserted into the socket connector 100, the external object may damage a portion 2203 that covers the end portion 2204 of the first plate 220 or the lips 241*d* of the plurality of terminals 241, whereby the plurality of terminals 241 may be separated from the first plate or bent. The bent end portion 251 of the second plate according to an embodiment of the disclosure may prevent an impact or load from an external object inserted into the socket connector 100 from being applied to the first plate 200 and the plurality of terminals 241. In an embodiment, the bent end portion 251 of the second plate 250 may have a structure which includes first end portions 252 bent in the first direction 2001 and second end portions 253 bent in the second direction 2002, and in which the first end portions and the second end portions are alternated.

Figure 2A:
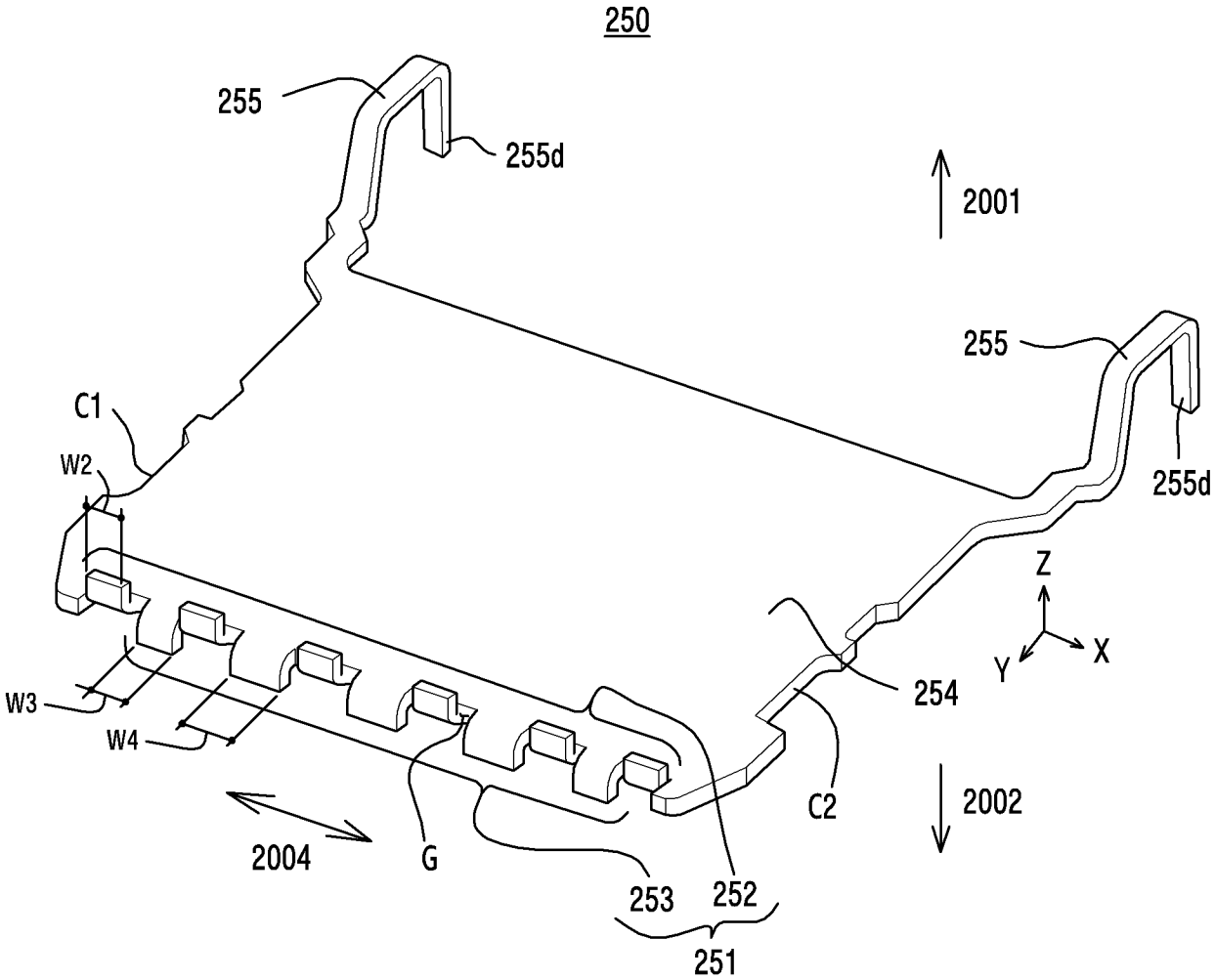
FIG. 2A is a perspective view of a second plate included in a connection part according to an embodiment.
Figure 2B:
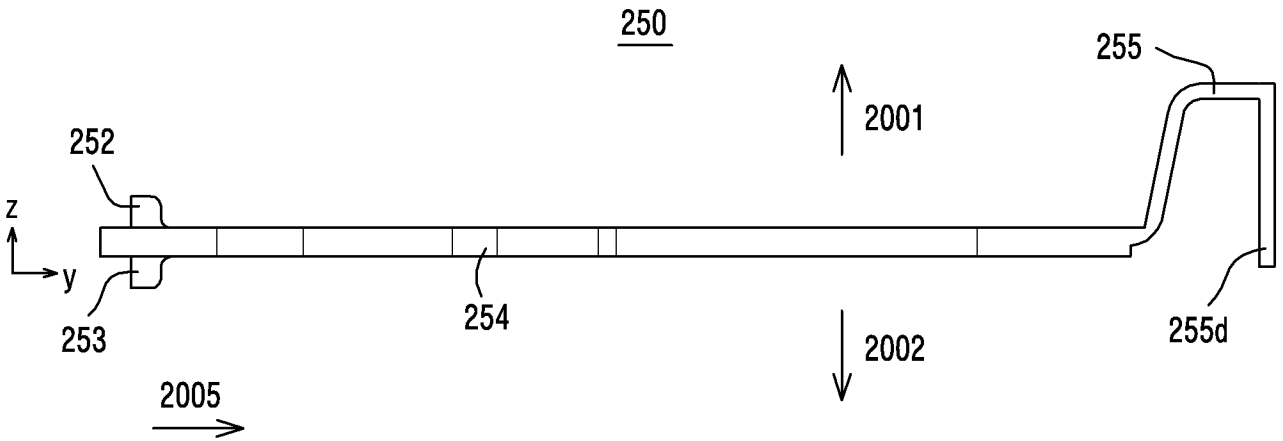
FIG. 2B is a side view of the second plate of FIG. 2A.
Figure 2C:
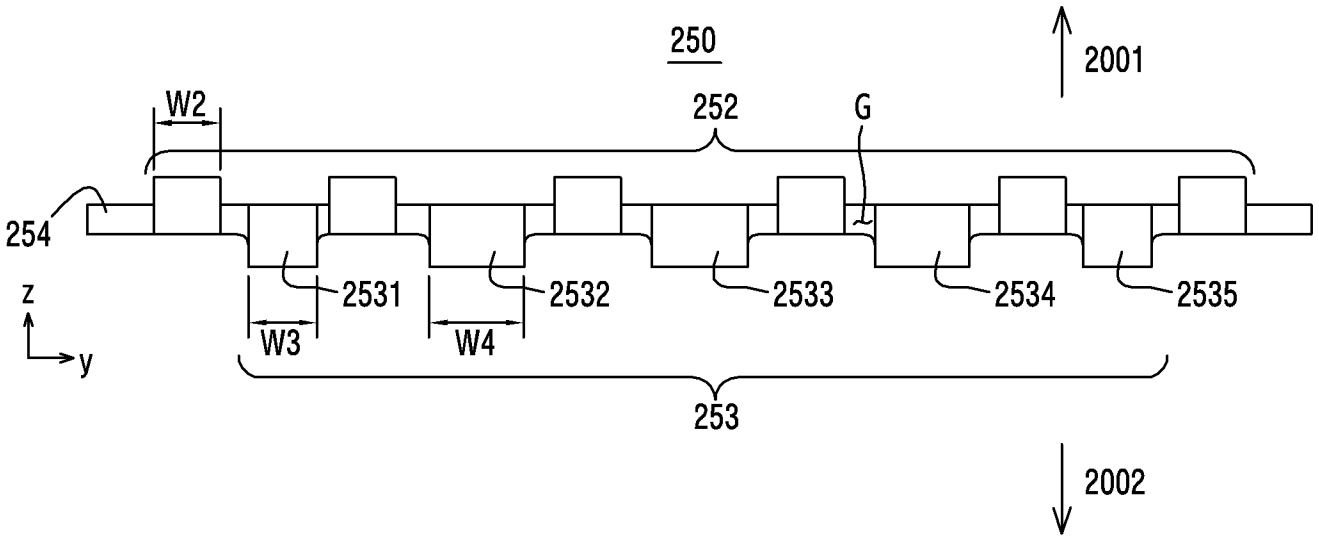
FIG. 2C is a front view of a portion of the second plate of FIG. 2A.

FIG. 2A is a perspective view of a second plate included in the connection part according to an embodiment. FIG. 2B is a side view of the second plate of FIG. 2A. FIG. 2C is a front view of a portion of the second plate of FIG. 2A.

Referring to FIGS. 2A, 2B, and 2C, the second plate 250 may include a flat portion 254, first end portions 252 bent in the first direction 2001 with respect to the flat portion 254, and second end portions 253 bent in the second direction 2002 with respect to the flat portion 254. The widths W2 of the first end portions 252 in the fourth direction 2004 may be designed to be constant, or in some embodiments, may be designed to be non-constant. The widths of the second end portions 253 in the fourth direction 2004 may be designed to be constant, or according to some embodiments, may be designed to be non-constant. For example, the width W4 of some of the second end portions 2532, 2533, and 2534 may be greater than the width W3 of the other second end portions 2531 and 2535. The gaps G between the first end portions 252 and the second end portions 253 may be designed to be constant, or according to some embodiments, may be designed to be non-constant. In an embodiment, further referring to FIG. 1B, the first plate 220 may include a portion (not illustrated) disposed in the gap G between the first end portions 252 and the second end portions 253.

The second plate 250 may include leads 255 extending from the flat portion 254, and the tails 255*d* of the leads 255 may be coupled to lands on a printed circuit board using soldering. A portion of the side surface of the second plate 250 may be used as terminals C1 and C2 electrically connected to a header connector (e.g., the header connector 190 in FIG. 1A).

Figure 2D:
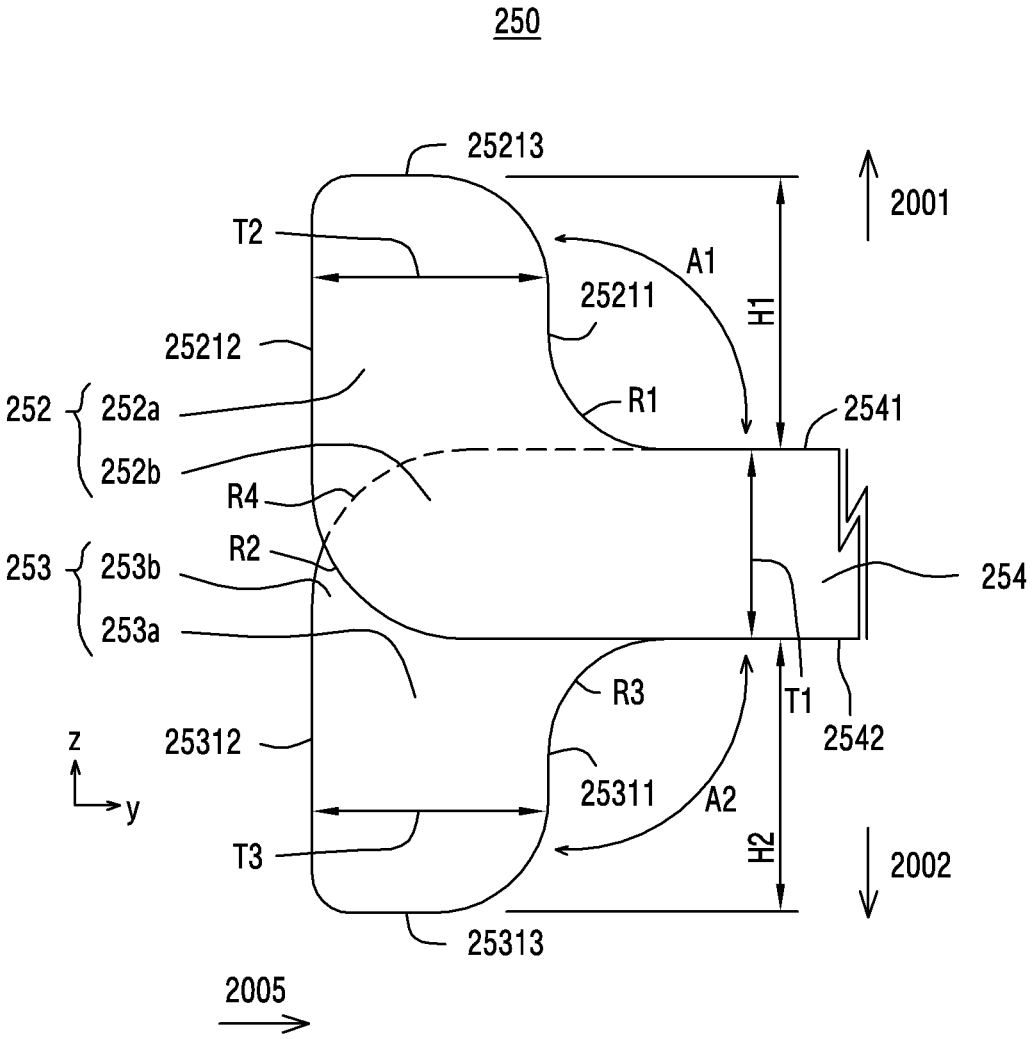
FIG. 2D is a cross-sectional view of a bent end portion of the second plate according to the embodiment.

FIG. 2D is a cross-sectional view of a bent end portion 251 of the second plate according to an embodiment.

Referring to FIG. 2D, the first end portions 252 may include a first wall portion 252*a* generally erected in the first direction 2001 and a first curved portion 252*b* between the first wall portion 252*a* and the flat portion 254. The second end portions 253 may include a second wall portion 253*a* generally erected in the second direction 2002 and a second curved portion 253*b* connecting the second wall portion 253*a* and the flat portion 254. According to an embodiment, the angle A1 at which the first wall portion 252*a* is erected in the first direction 2001 with respect to the flat portion 254 or the angle A2 at which the second wall portion 253*a* is erected in the second direction 2002 with respect to the flat portion 254 may be about 90 degrees. The first curved portion 252*b* may include curved surfaces R1 and R2 that smoothly connect opposite surfaces 2541 and 2542 of the flat portion 254 and opposite surfaces 25211 and 25212 of the first wall portion 252*a*, and the second curved portion 253*b* may include curved surfaces R3 and R4 that smoothly connect opposite surfaces 2541 and 2542 of the flat portion 254 and opposite surfaces 25311 and 25312 of the second wall portion 253*a*. According to some embodiments, the curved surfaces R1 and R2 of the first curved portion 252*b* or the curved surfaces R3 and R4 of the second curved portion 253*b* may be designed in a corner shape. The heights H1 of the first end portions 252 erected in the first direction 2001 with respect to the flat portion 254 may be constant, and the heights H2 of the second end portions 253 erected in the second direction 2002 with respect to the flat portion 254 may be constant. According to some embodiments, the height H1 of the first end portions 252 or the height H2 of the second end portions 253 may be designed to be non-constant. According to some embodiments, the height H1 of the first end portions 252 and the height H2 of the second end portions 253 may be designed to be the same as or different from each other.

According to various embodiments, the resistance structure of the first end portions 252 or the second end portions 253 against an external impact or load may be designed such that the curved surface R1 of the first curved portion 252*b* or the curved surface R3 of the second curved portion 253*b* is deformed into a gentler shape. For example, the thickness T2 of the first wall portion 252*a* or the thickness T3 of the second wall portion 253*a* may be designed to be different from the thickness T1 of the flat portion 254. For example, the first wall portion 252*a* may be formed to be narrowed in the first direction 2001, and the second wall portion 253*a* may be formed to be narrowed in the second direction 2002. For example, the angle A1 at which the first wall portion 252*a* is erected in the first direction 2001 with respect to the flat portion 254 or the second angle A2 at which the second wall portion 253*a* is erected in the second direction 2002 with respect to the flat portion 254 may be designed at an angle different from 90 degrees. For example, one surface 25212 of the first wall portion 252*a* and/or one surface 25312 of the second wall portion 253*a* may be designed as a curved surface. For example, a rib extending from the wall portion 252*a* or 253*a* or the flat portion 254 to the inside of the first plate 220 may be formed.

In various embodiments, referring to FIGS. 1A and 1B, when an impact or load caused by an external object (e.g., the header connector 190) is applied to the connection part 120, the connection part 120 may be bent or sagged in the first direction 2001 or the second direction 2002. The support member 230, the first plate 220, the second plate 250, and the conductive patterns 240 of the connection part 120 may be designed to have resistance or rigidity against bending or sagging of the connection part 120. For example, an organic bonding layer, such as a polymer, may be interposed at the interface between the first plate 220 and the second plate 250 so that the bonding force between the first plate 220 and the second plate 250 can be improved. For example, the interface between the first plate 220 and the second plate 250 may be designed to include a concave-convex fitting structure (e.g., a dovetail joint) so as to improve the bonding force between the first plate 220 and the second plate 250. In addition, various resistance structures for the connection part 120 for preventing damage to the connection part 120 from an external impact or load may be provided.

According to an embodiment, referring to FIGS. 1C and 2D, when viewed in the direction opposite the third direction 2003 (hereinafter, a "fifth direction") 2005, the first wall portion 252*a* may be formed to have a height that does not overlap the first terminals 241*a*, or the second wall portion 253*a* may be formed to have a height that does not overlap the second terminals 241*b*. According to some embodiments, when viewed in the fifth direction 2005, the first wall portion 252*a* may be formed to have a height that overlaps the first terminals 241*a*, or the second wall portion 253*a* may be formed to have a height that overlaps the second terminals 241*b*.

In an embodiment, referring to FIGS. 1C and 2D, the first wall portion 252*a* may not protrude in the first direction 2001 with respect to the first plate 220, or the second wall portion 253*a* may not protrude in the second direction 2002 with respect to the first plate 220. For example, one surface

25213 of the first wall portion 252*a* or one surface 25313 of the second wall portion 253*a* may be covered by a portion 2204 of the first plate 220.

In an embodiment, referring to FIGS. 1C and 2D, the first wall portion 252*a* or the second wall portion 253*a* may not protrude in the third direction 2003 with respect to the first plate 220. For example, one surface 25212 of the first wall portion 252*a* or one surface 25312 of the second wall portion 253*a* may be covered by a portion of the first plate 220. According to some embodiments, one surface 25212 of the first wall portion 252*a* or one surface 25312 of the second wall portion 253*a* may be disposed to be exposed.

Figure 3:
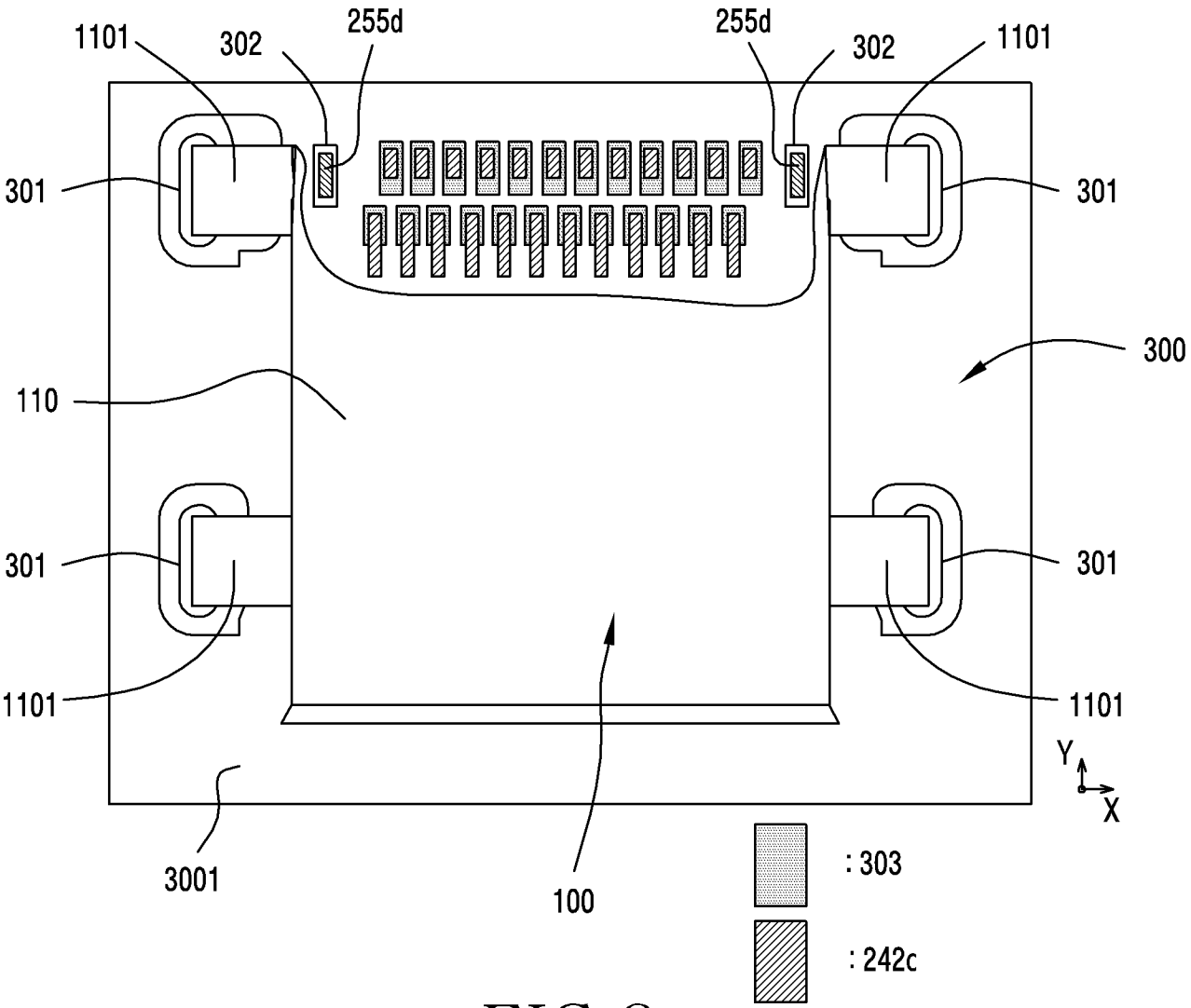
FIG. 3 illustrates a printed circuit board (PCB) on which the socket connector according to the embodiment is mounted.

FIG. 3 illustrates a printed circuit board on which a socket connector according to an embodiment is mounted. At least one of the constituent elements of the socket connector may be the same as or similar to at least one of the constituent elements in FIGS. 1A to 1C, and a redundant description will be omitted below.

Referring to FIG. 3, in one embodiment, the housing 110 of the socket connector 100 may be placed on one surface 3001 of the printed circuit board 300, and a plurality of leads 1101 extending from the housing 110 may be inserted into a plurality of component holes 301 in the printed circuit board 300. The end portions 1101*a* of the leads 1101 may protrude with respect to the opposite surface of the printed circuit board 300, and the protruding end portions 1101*a* may be coupled to lands formed around the component holes 301 (e.g., copper foil pads) (not illustrated), respectively, using soldering. Thereby, the housing 100 may be electrically connected to a ground on the printed circuit board 300. According to some embodiments, a housing, from which the leads 1101 are omitted, may be designed. For example, a conductive bonding layer may be disposed between the housing and the printed circuit board, and the conductive bonding layer may establish coupling as well as electrical connection between the housing and the printed circuit board. In addition, various other housings may be designed.

According to an embodiment, the leads of the socket connector 100 (e.g., the leads 242 in FIG. 1B) may include tails extending to the outside of the support member (e.g., the support member 230 in FIG. 1B), and the tails 242*c* may be coupled to the lands 303 on the printed circuit board 300 using soldering. The terminals 241 may be electrically connected to elements (e.g., a processor, a power management circuit, and a ground) mounted on the printed circuit board 300.

According to an embodiment, the leads (e.g., the leads 255 in FIG. 1B) extending from the second plate (e.g., the second plate 250 in FIG. 1B) of the socket connector 100, and the tails 255*d* of the leads 255 may be coupled to the lands 302 on the printed circuit board 300 using soldering. According to an embodiment, the second plate 250 may be electrically connected to the ground of the printed circuit board 300.

According to some embodiments, the second plate 250 may be formed of a non-metal material, and the leads 255 and lands 302 on the printed circuit board (the printed circuit board 300 in FIG. 3) may be omitted.

Figure 4:
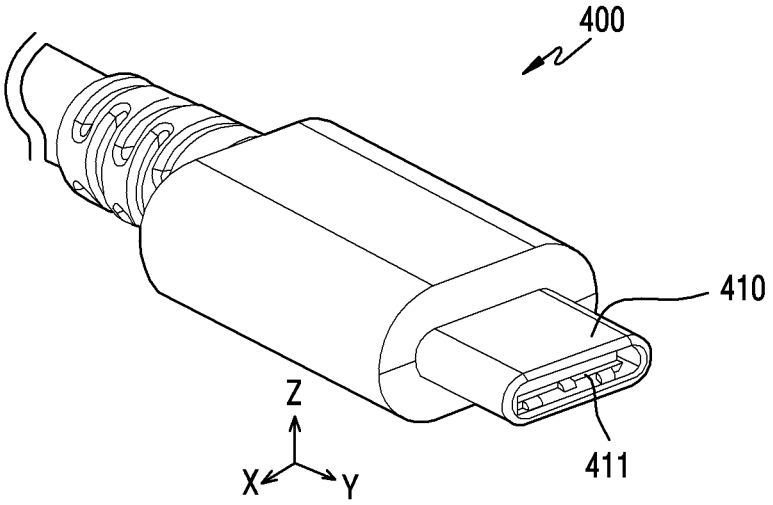
FIG. 4 is a perspective view of a type-C header connector according to an embodiment.
Figure 5:
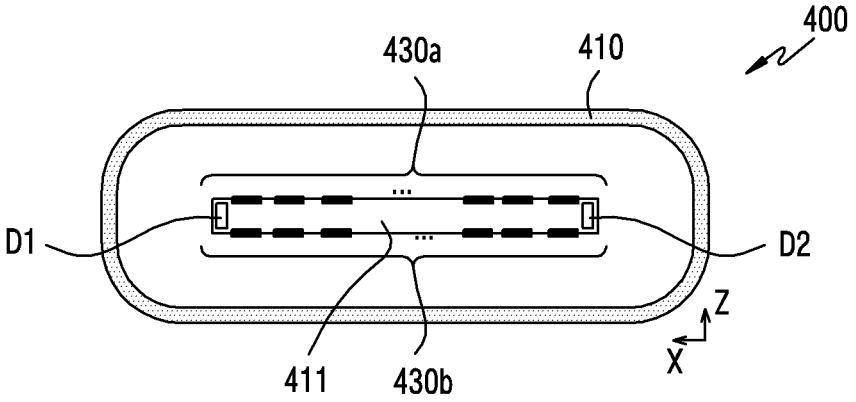
FIG. 5 is a front view of the type-C header connector according to the embodiment.
Figure 6:
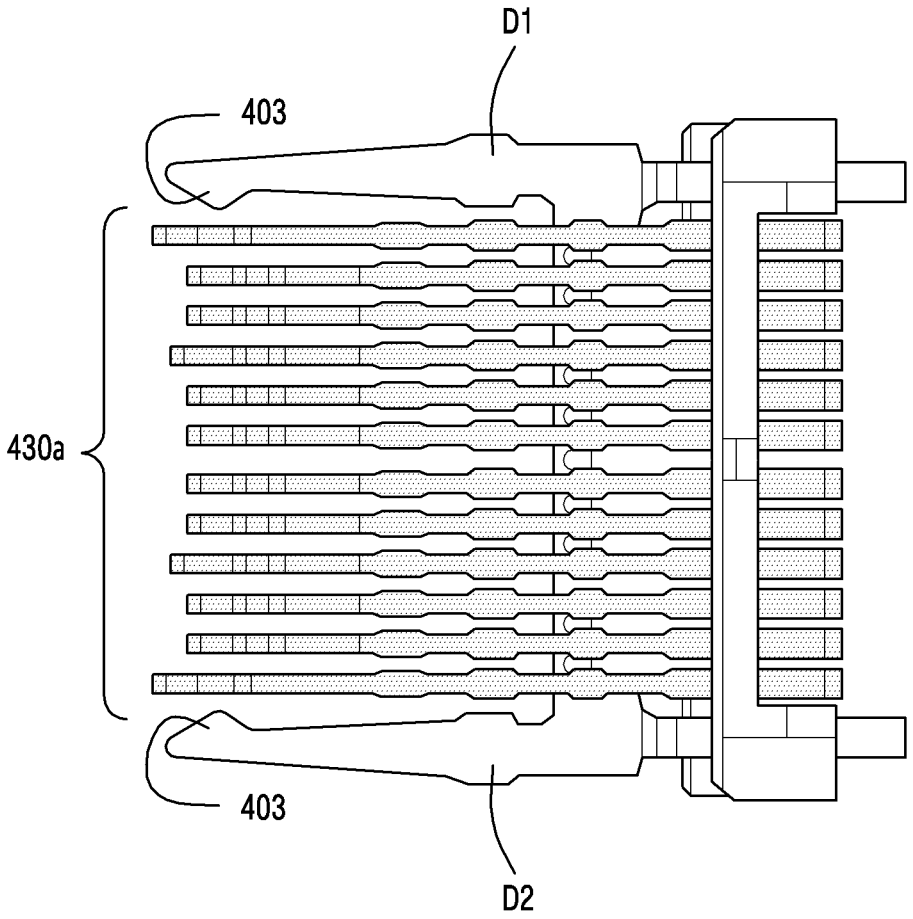
FIG. 6 illustrates a plurality of terminals and internal structures installed in the housing of the type-C header connector according to the embodiment.

FIG. 4 is a perspective view of a type-C header connector according to the embodiment. FIG. 5 is a front view of the type-C header connector according to the embodiment. FIG. 6 illustrates a plurality of terminals and internal structures installed in a housing of the type-C header connector according to the embodiment.

Referring to FIG. 4, a type-C header connector (e.g., a plug) 400 (e.g., the header connector 190 in FIG. 1A) may include a housing 410 in a form that can be inserted into an inner space 111 of the housing 110 of a socket connector (e.g., the socket connector 100 in FIG. 1A), and the housing 410 may include a slot 411 having an opening. The slot 411 may be the space into which a portion of the connection part 120 of the socket connector (e.g., the socket connector 100 in FIG. 1A) is inserted.

Referring to FIG. 5, the header connector 400 may include a plurality of terminals 430*a* and 430*b* arranged on opposite inner surfaces of the slot 411. When the socket connector (e.g., the socket connector 100 in FIG. 1A) and the header connector 400 are coupled, the housing 410 may be inserted into the inner space 111 of the socket connector (e.g., the socket connector 100 in FIG. 1A), and the connection part (e.g., the connection part 120 in FIG. 1A) of the socket connector 100 may be inserted into the slot 411. When the connection part 120 of the socket connector 100 is inserted into the slot 411, the terminals 240 of the socket connector 100 may be electrically connected to the terminals 430*a* and 430*b* of the header connector 400, respectively. The header connector 400 may include terminals (hereinafter, referred to as "D terminals") D1 and D2 corresponding to C terminals (e.g., the C terminals C1 and C2 in FIG. 1B) of the socket connector 100. According to an embodiment, the D terminals D1 and D2 are cantilever-like structures (e.g., latches), and may be used for physical connection as well as electrical connection between the socket connector 100 and the header connector 400.

Referring to FIG. 6, each of the free ends of the D terminals D1 and D2 may include a hook 403 for snap-fit fastening. When the header connector 400 is inserted into the socket connector (e.g., the socket connector 100 in FIG. 1A), the D terminals D1 and D2 may be fastened to the hook fastening portions (e.g., the hook fastening portions 120031 in FIG. 1B) formed on the side surfaces of the connection part (e.g., the connection part 120 in FIG. 1B) through elastic bending deformation, and may be electrically connected to the C terminals C1 and C2 of the socket connector 100. Further referring to FIG. 1B, the hook fastening portions 120031 may have a structure including engagement steps that prevent the hooks 403 of the header connector 400 from being released in the third direction 2003. When the D terminals D1 and D2 of the header connector 400 are coupled to the hook fastening portions 120031 of the socket connector 100, the D terminals D1 and D2 of the header connector 400 may be electrically connected to the C terminals C1 and C2 of the socket connector 100. According to an embodiment, a control circuit (e.g., a processor) of the electronic device may detect electrical connection between the C terminals C1 and C2 of the socket connector 100 and the D terminals D1 and D2 of the header connector 400 through a pull-up resistor circuit, a pull-down resistor circuit, or the like. According to various embodiments, the control circuit may perform various operation flows depending on whether the C terminals C1 and C2 of the socket connector 100 and the D terminals D1 and D2 of the header connector 400 are electrically connected to each other. For example, when the control circuit detects the electrical connection between the C terminals C1 and C2 of the socket connector 100 and the D terminals D1 and D2 of the header connector 400, the socket connector 100 may recognize that the header connector 400 is in the state of being connected to the socket connector 100. For example, the control circuit may control various electronic components depending whether the C terminals C1 and C2 of the socket connector 100 and the D terminals D1 and D2 of the header connector 400 are electrically connected to each other. For example, the control circuit may switch between the corresponding operation modes depending on whether the C terminals C1 and C2 of the socket connector 100 and the D terminals D1 and D2 of the header connector 400 are electrically connected. These operation modes may be related to a software program or various functions supported by at least one electronic component.

Figure 7A:
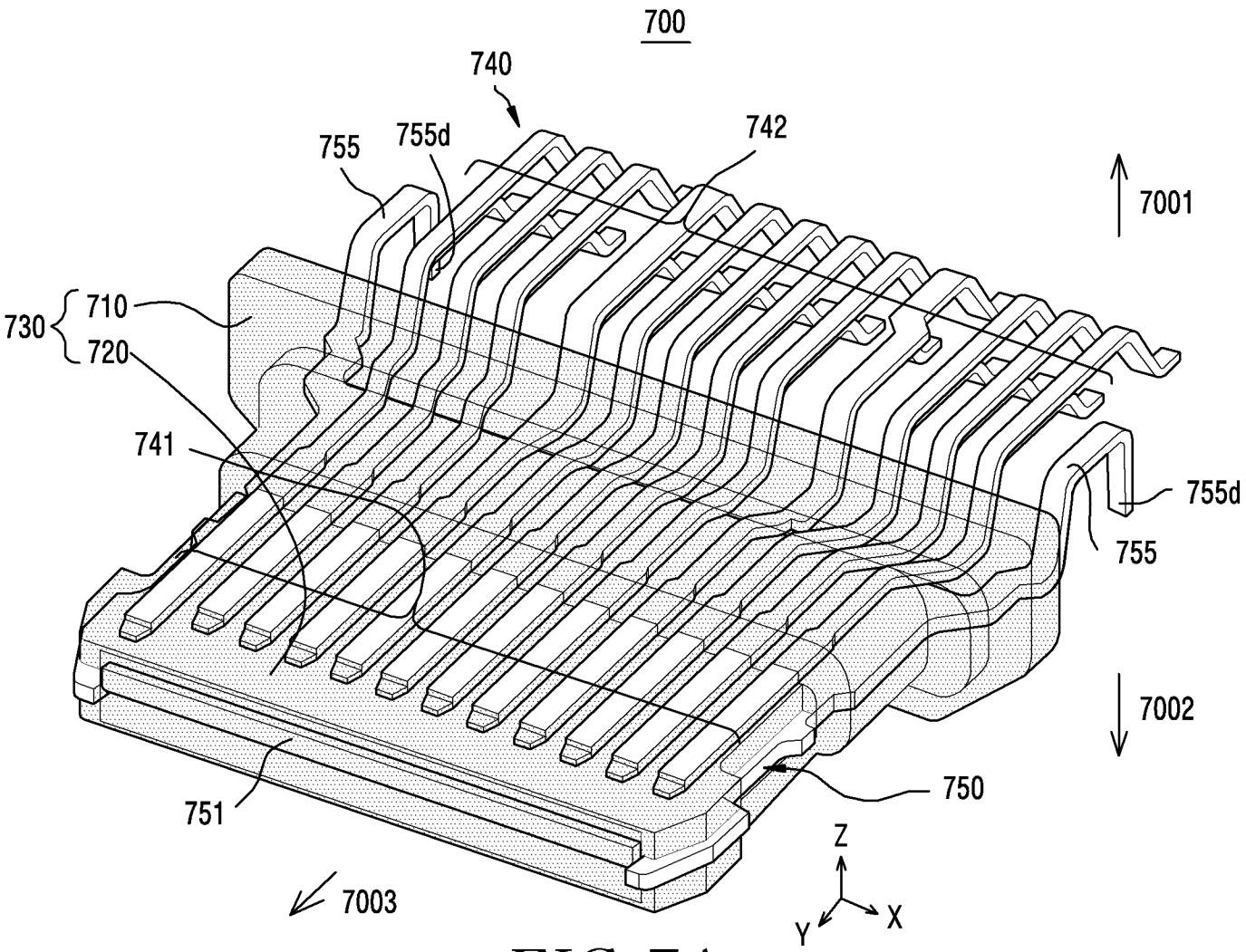
FIG. 7A is a perspective view of a connection part coupled to a housing of a socket connector according to another embodiment.
Figure 7B:
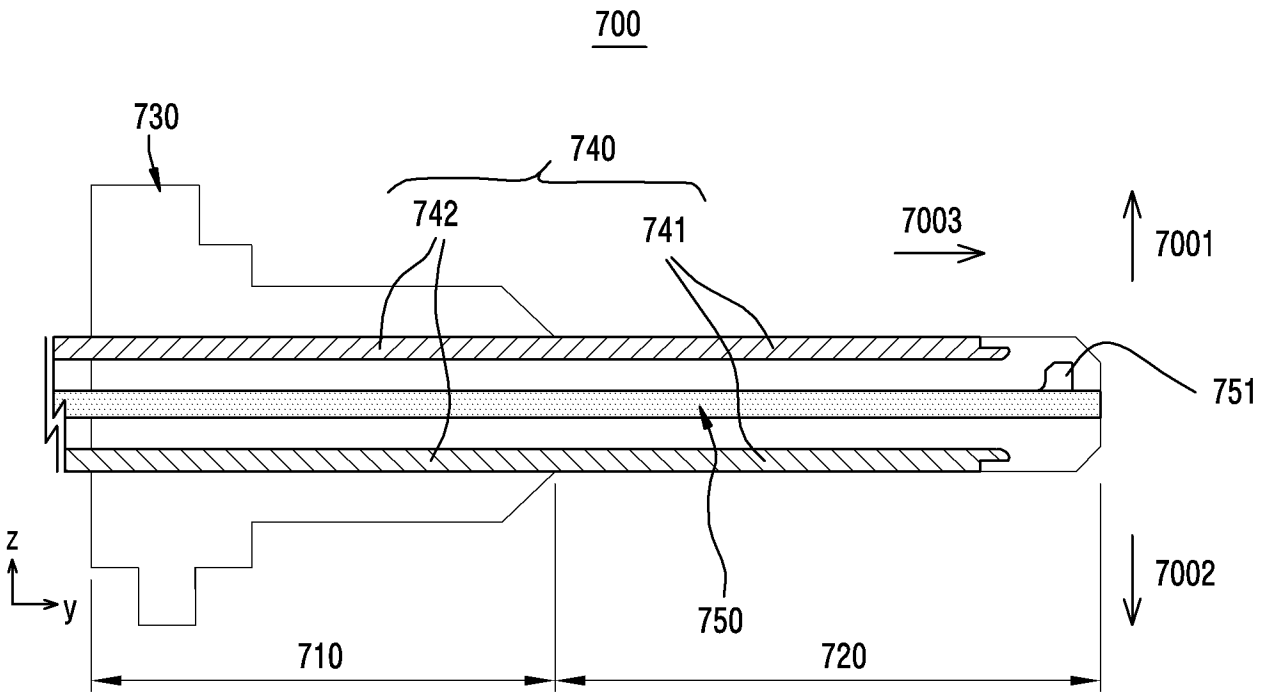
FIG. 7B is a cross-sectional view of the connection part of FIG. 7A.
Figure 7C:
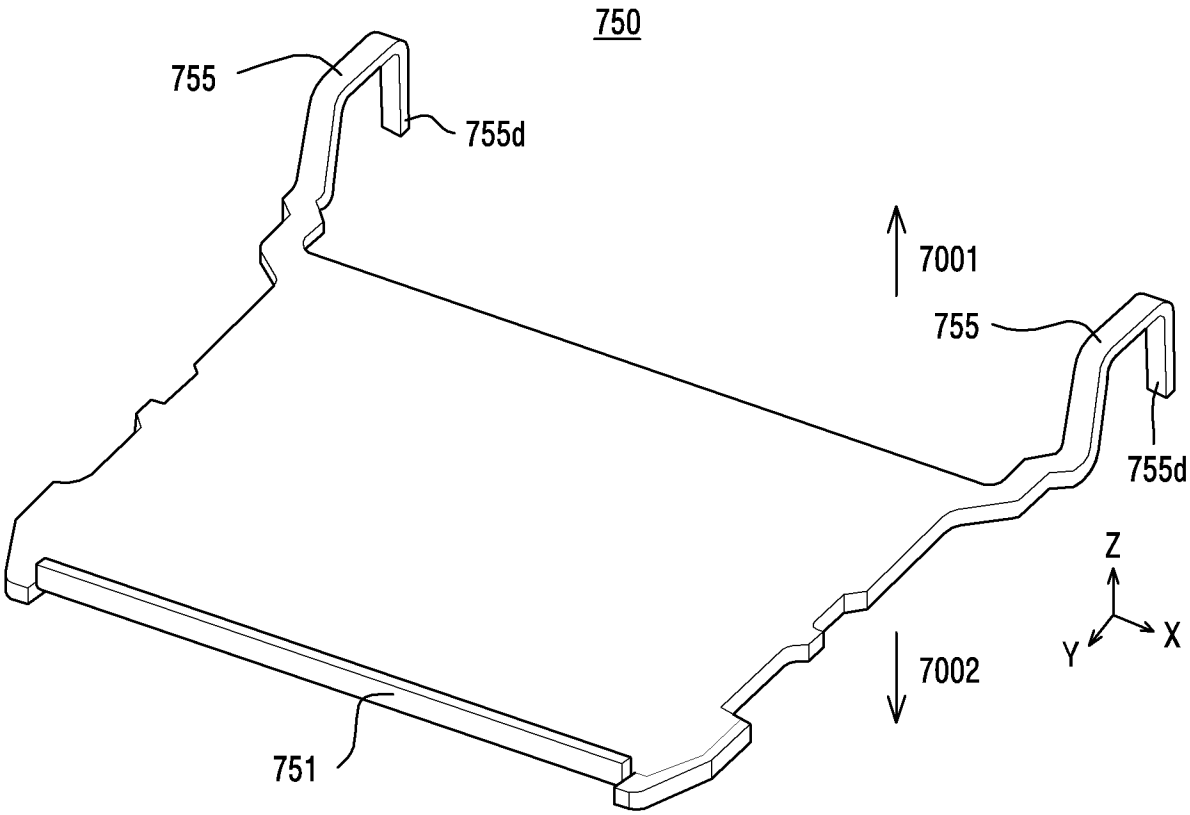
FIG. 7C is a perspective view of a second plate included in the connection part of FIG. 7A.
Figure 7D:
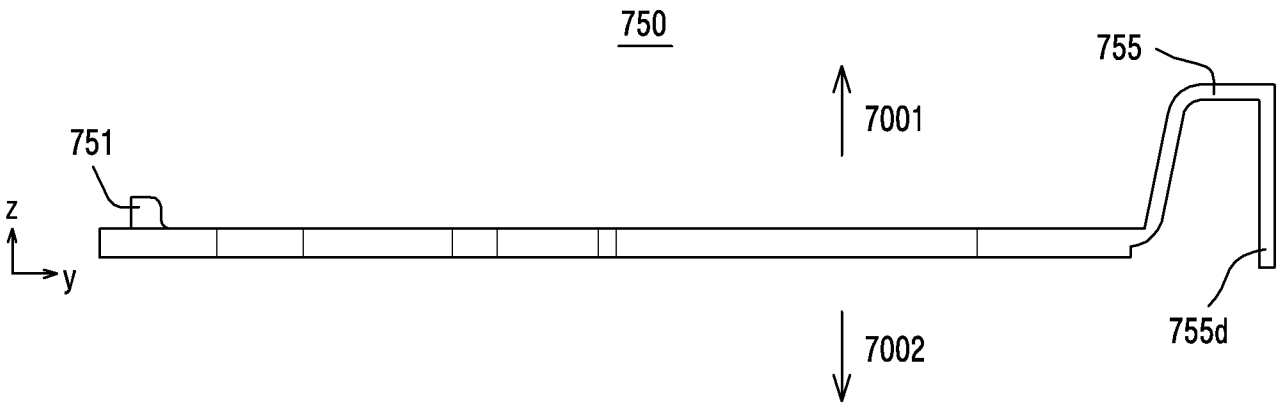
FIG. 7D is a side view of the second plate of FIG. 7C.
Figure 7E:
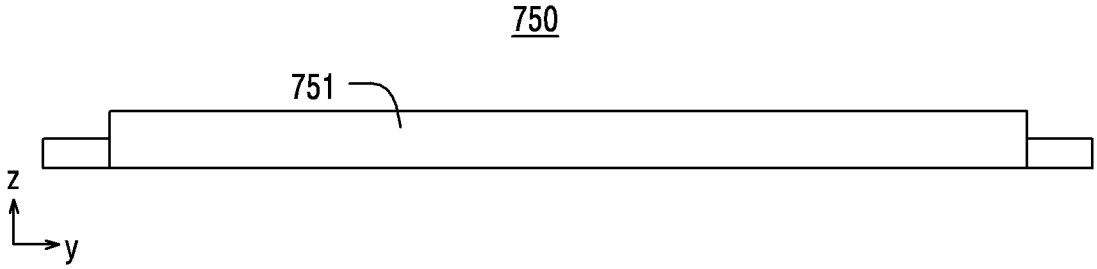
FIG. 7E is a front view of a portion of the second plate of FIG. 7C.

FIG. 7A is a perspective view of a connection part coupled to a housing of a socket connector according to another embodiment. FIG. 7B is a cross-sectional view of the connection part of FIG. 7A. FIG. 7C is a perspective view of a second plate included in the connection part of FIG. 7A. FIG. 7D is a side view of the second plate of FIG. 7C. FIG. 7E is a front view of a portion of the second plate of FIG. 7C. At least one of the constituent elements of the socket connector may be the same as or similar to at least one of the constituent elements of the socket 100 in FIGS. 1A to 1D, and a redundant description will be omitted below.

The connection 700 of FIGS. 7A and 7B may be replaced with the connection part 120 of FIGS. 1A and 1B. In an embodiment, referring to FIGS. 1, 7A, and 7B, the connection part 700 may include a base 710 coupled to the first opening 110*a* of the housing 110 of the socket connector 100. The connection part 700 may include a first plate 720 extending from the base 710 in the separation direction 7003 (e.g., the third direction 2003 in FIG. 1A) of the header connector (e.g., the header connector 190 in FIG. 1A or the header connector 400 in FIG. 4). The base 710 and the first plate 720 may be designed as an integral support member 730 formed of a non-conductive material.

The connection part 700 may include a plurality of conductive patterns 740 coupled to the support member 730. The conductive patterns 740 are physically separated from each other, and may include a plurality of terminals 741 arranged on the opposite surfaces of the first plate 720 and a plurality of leads 742 extending from the terminals 741 and penetrating the base 710. The plurality of leads 742 may be coupled to a printed circuit board (e.g., the printed circuit board 300 in FIG. 3) using soldering.

The connection part 700 may include a second plate 750, which is made of a conductive material and has at least a portion disposed inside the support member 730. According to an embodiment, the second plate 750 may be designed to have a strength (e.g., tensile strength, flexural strength, shear strength, compressive strength, fatigue strength, or the like) greater than that of the first plate 720 so as to increase the endurance of the connection part 120. The second plate 750 is physically separated from the conductive patterns 740, and the non-conductive material of the first plate 720 may be disposed between the second plate 750 and the conductive patterns 740. Further referring to FIGS. 7C, 7D, and 7E, the connection part 700 may include leads 755 extending from the second plate 750 to the outside of the support member 730, and the tails 755*d* of the leads 755 may be coupled to a printed circuit board (e.g., the printed circuit board 300 in FIG. 3) using soldering. According to an embodiment, the second plate 750 may include a portion 751 that protrudes further than the terminals 741 in the third direction 7003, and the protruding portion 751 may be designed in a form bent in a first direction 7001 (e.g., the first direction 2001 in FIG. 1B). The bent end portion 751 of the second plate 750 may prevent the first plate 720 and/or the terminals 741 from being damaged by an external object inserted into the socket connector. According to an embodiment, the bent end portion 751 may have a structure similar to the first end portions 252 in FIG. 2D, and a detailed description thereof will be omitted. According to some embodiments, although not illustrated, the second plate may be designed to have a second end portion bent in a second direction 7002 opposite the first direction 7001, instead of the end portion 751 bent in the first direction 7001.

Figure 8A:
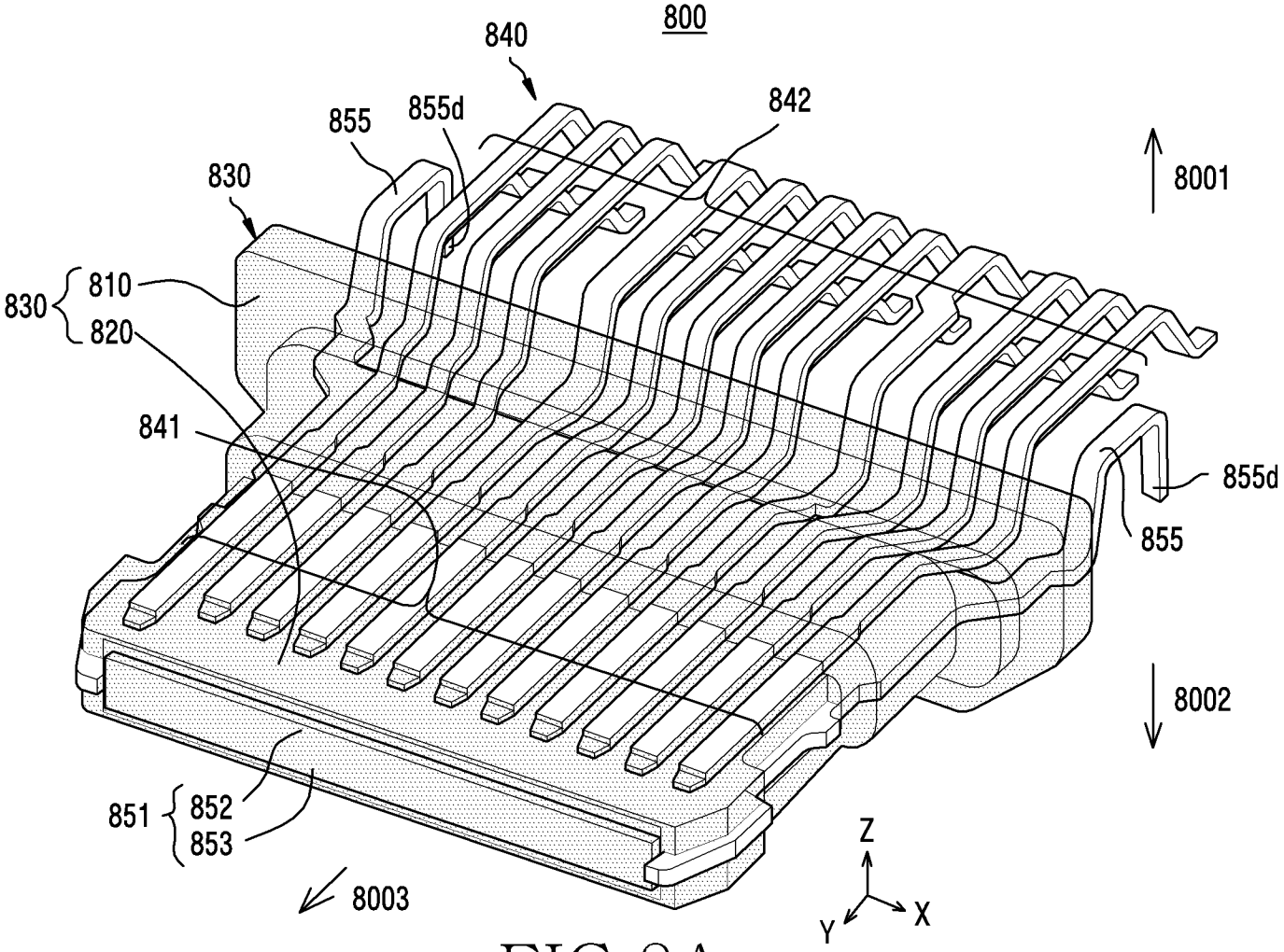
FIG. 8A is a perspective view of a connection part coupled to a housing of a socket connector according to still another embodiment.
Figure 8B:
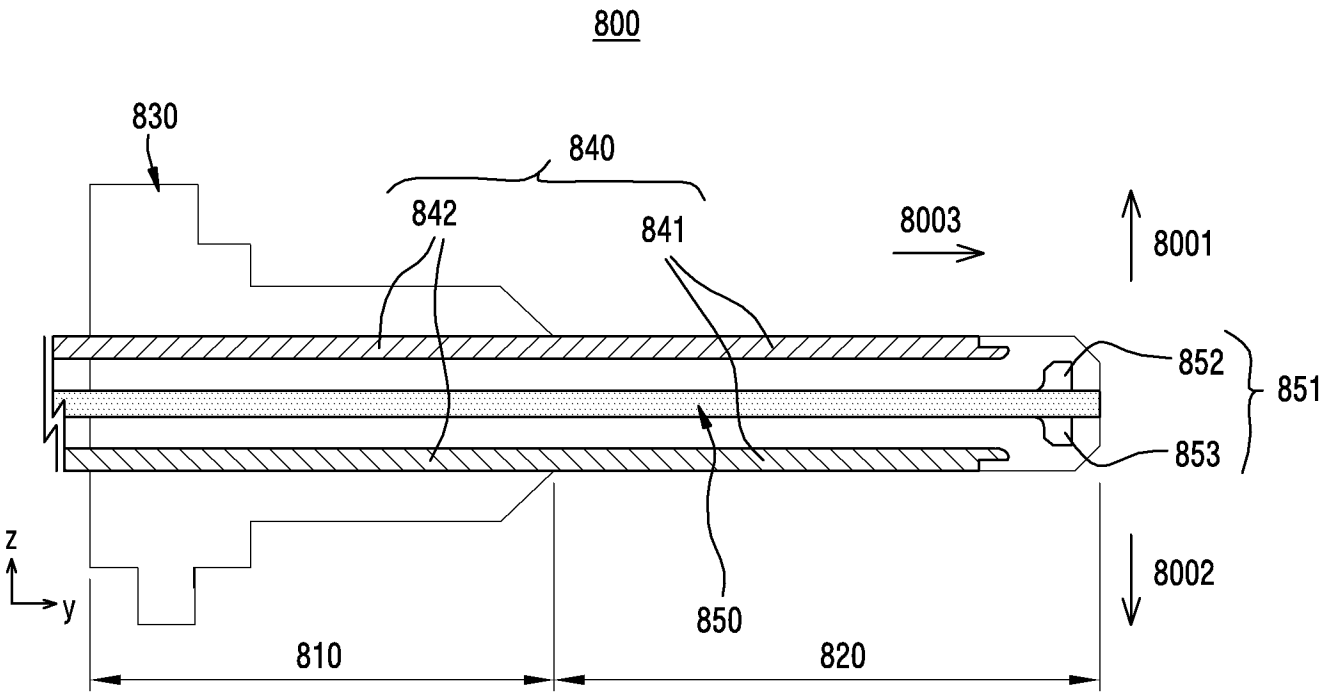
FIG. 8B is a cross-sectional view of the connection part of FIG. 8A.
Figure 8C:
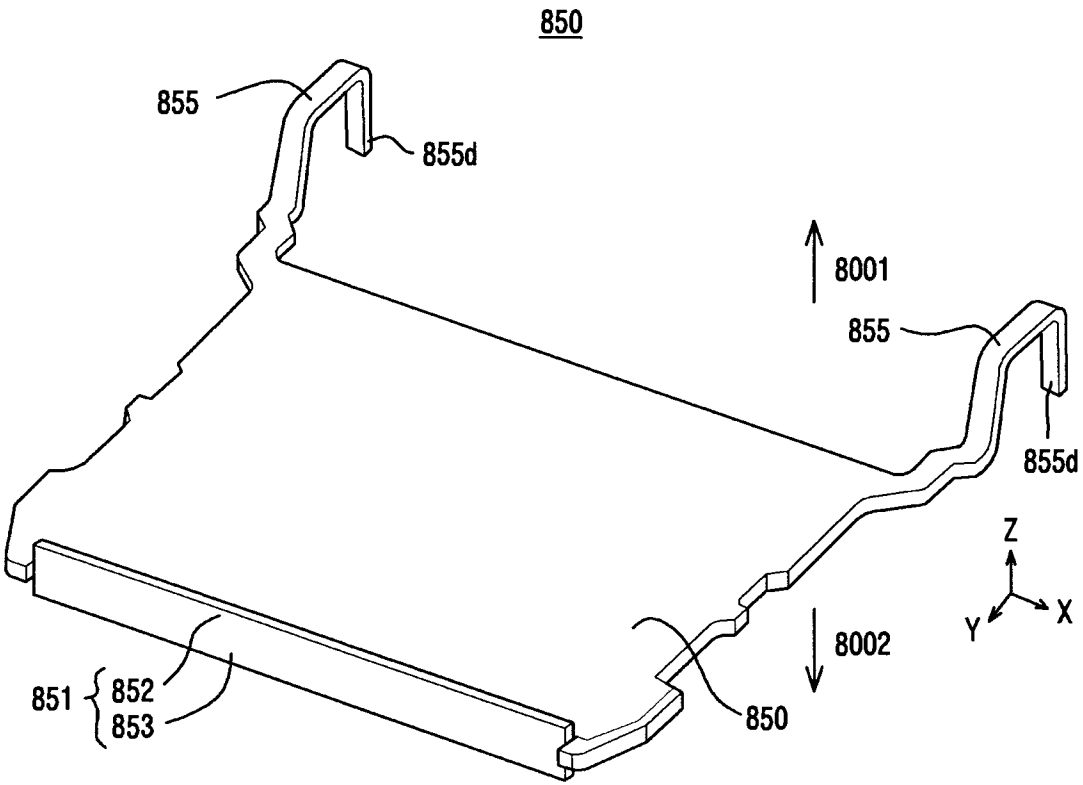
FIG. 8C is a perspective view of a second plate included in the connection part of FIG. 8A.
Figure 8D:
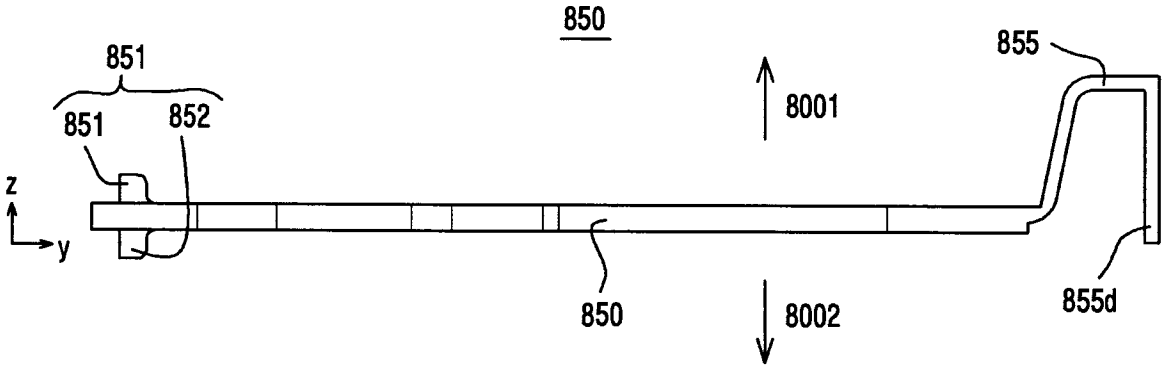
FIG. 8D is a side view of the second plate of FIG. 8C.
Figure 8E:
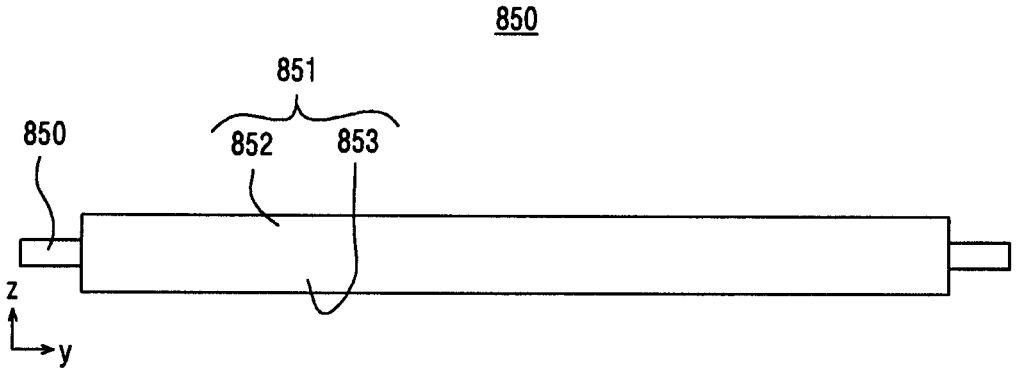
FIG. 8E is a front view of a portion of the second plate of FIG. 8C.

FIG. 8A is a perspective view of a connection part coupled to a housing of a socket connector according to still another embodiment. FIG. 8B is a cross-sectional view of the connection part of FIG. 8A. FIG. 8C is a perspective view of a second plate included in the connection part of FIG. 8A. FIG. 8D is a side view of the second plate of FIG. 8C. FIG. 8E is a front view of a portion of the second plate of FIG. 8C. At least one of the constituent elements of the socket connector of FIGS. 1A to 1D may be the same as or similar to at least one of the constituent elements in FIGS. 1A to 1D, and a redundant description will be omitted below.

A connection part 800 in FIGS. 8A and 8B may be replaced with the connection part 120 in FIGS. 1A and 1B. In an embodiment, referring to FIGS. 1A to 1D, 8A, and 8B, the connection part 800 may include a base 810 coupled to the first opening 110*a* in the housing 110 of the socket connector 100. The connection part 800 may include a first plate 820 extending from the base 810 in the separation direction 8003 (e.g., the third direction 2003 in FIG. 1A) of the header connector (e.g., the header connector 190 in FIG. 1A or the header connector 400 in FIG. 4). The base 810 and the first plate 820 may be designed as an integral support member 830 formed of a non-conductive material.

According to an embodiment, the connection part 800 may include a plurality of conductive patterns 840 coupled to the support member 830. The conductive patterns 840 are physically separated from each other, and may include a plurality of terminals 841 arranged on the opposite surfaces of the first plate 820 and a plurality of leads 842 extending from the terminals 841 and penetrating the base 810. The plurality of leads 842 may be coupled to a printed circuit board (e.g., the printed circuit board 300 in FIG. 3) using soldering.

The connection part 800 may include, for example, a second plate 850, which is made of a conductive material and has at least a portion disposed inside the support member 830. According to an embodiment, the second plate 850 may be designed to have a strength (e.g., tensile strength, flexural strength, shear strength, compressive strength, fatigue strength, or the like) greater than that of the first plate 820 so as to increase the endurance of the connection part 800. The second plate 850 is physically separated from the conductive patterns 840, and the non-conductive material of the first plate 820 may be disposed between the second plate 850 and the conductive patterns 840. Further referring to FIGS. 8C, 8D, and 8E, the connection part 800 may include leads 855 extending from the second plate 850 to the outside of the support member 830, and the tails 855*d* of the leads 855 may be coupled to a printed circuit board (e.g., the printed circuit board 300 in FIG. 3) using soldering. According to an embodiment, the second plate 850 may include a portion 851 that protrudes further than the terminals 841 in the third direction 8003, and the protruding portion 851 may include a first end portion 852 in the form bent in a first direction 8001 (e.g., the first direction 2001 in FIG. 1B) and a second end portion 853 in the form bent in a second direction 8002 (e.g., the second direction 2002 in FIG. 1B). The bent end portion 851 of the second plate 850 may prevent the first plate 820 and/or the terminals 841 and 842 from being damaged by an external object inserted into the socket connector. According to an embodiment, the protruding portion 851 may be a plate orthogonally coupled to the flat portion 845.

Figure 9:
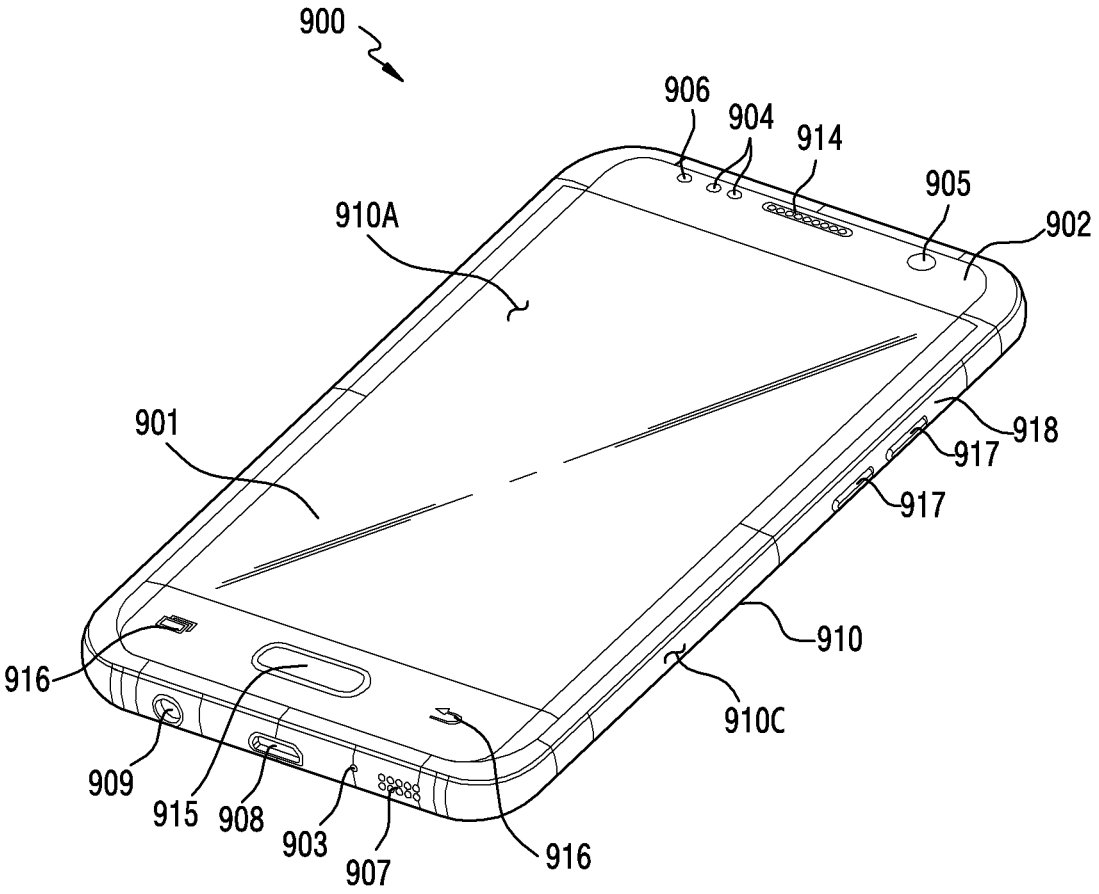
FIG. 9 is a perspective view of the front side of an electronic device including a socket connector according to an embodiment.
Figure 10:
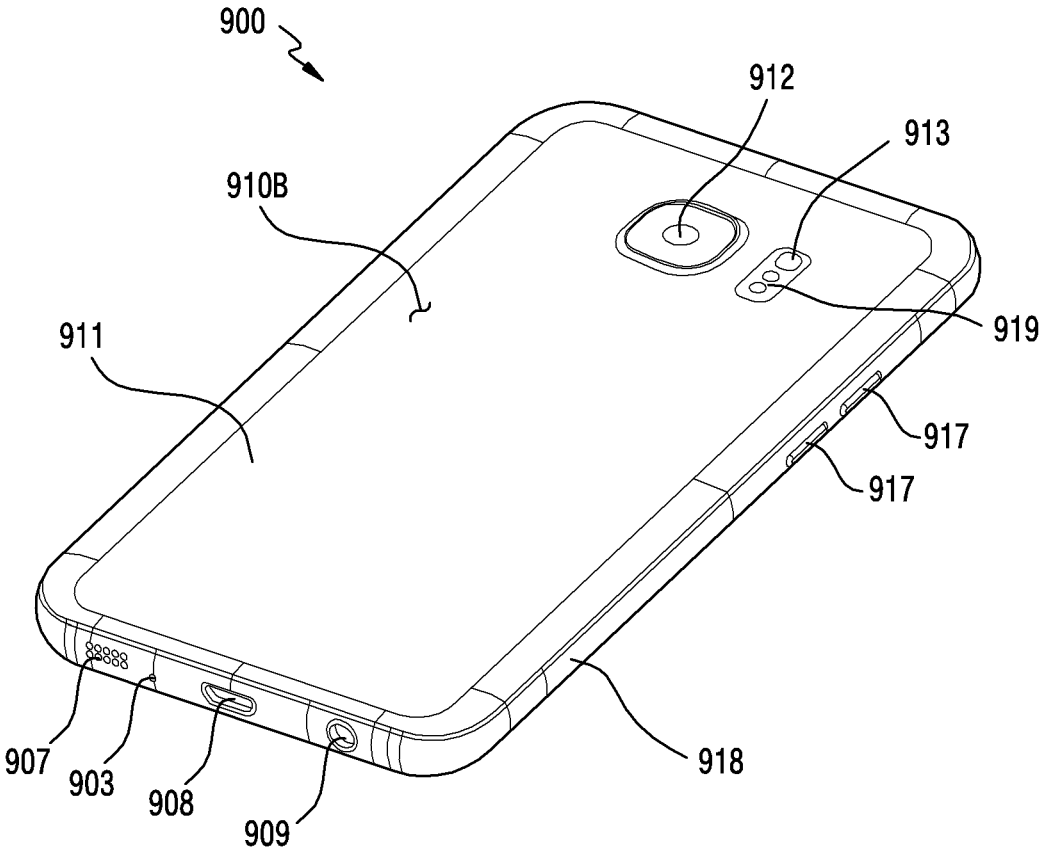
FIG. 10 is a perspective view of the rear side of the electronic device including the socket connector of FIG. 9.
Figure 11:
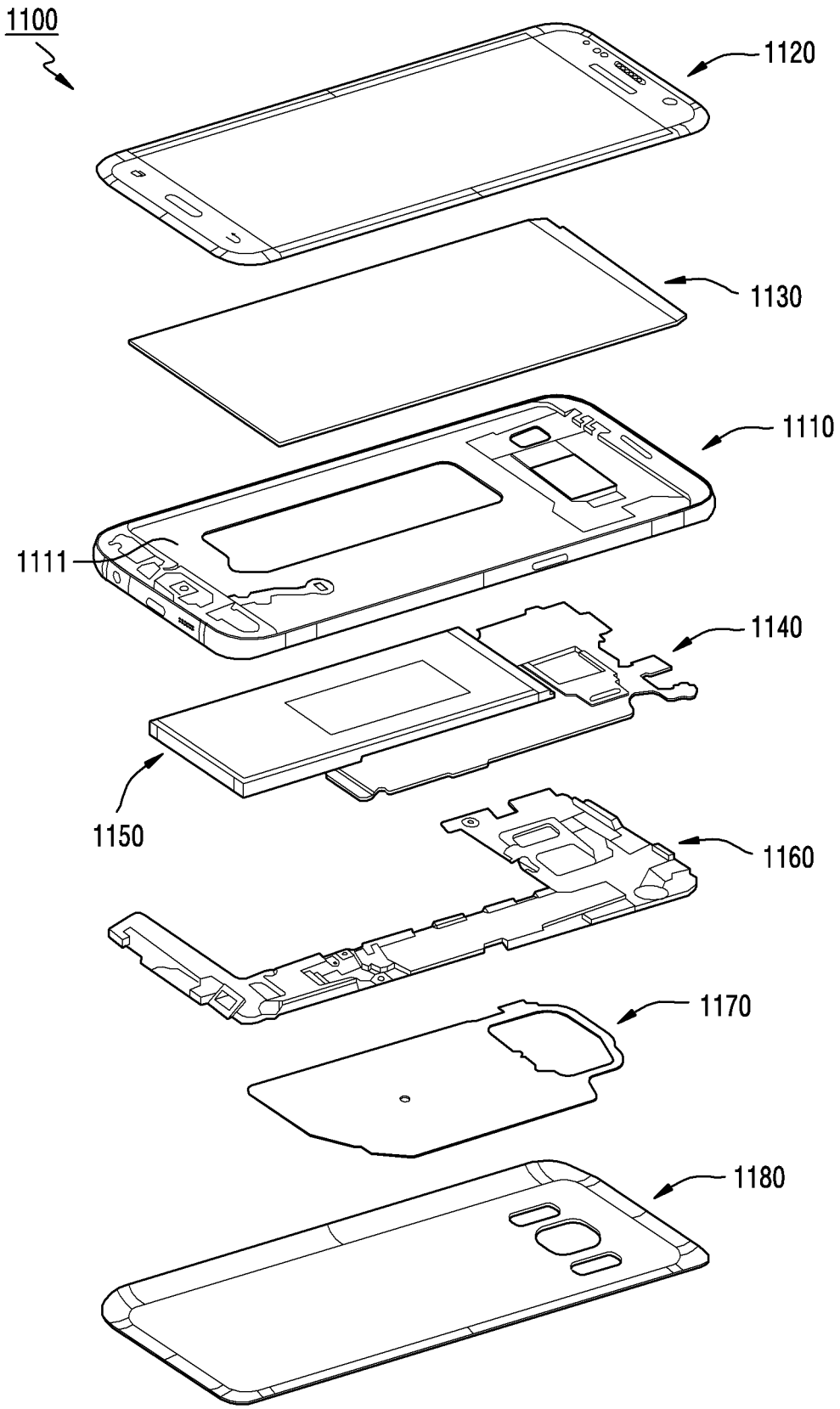
FIG. 11 is an exploded perspective view of the electronic device including the socket connector of FIG. 9.

FIG. 9 is a front perspective view illustrating an example mobile electronic device according to various embodiments. FIG. 10 is a rear perspective view illustrating an example mobile electronic device of FIG. 9. FIG. 11 is an exploded perspective view illustrating an example electronic device of FIG. 9 according to various embodiments.

Referring to FIG. 9 and FIG. 10, an electronic device 900 according to an embodiment may include a housing 910 including a first side (or a front side) 910A, a second side (or a rear side) 910B, and a lateral side (surface) 910C surrounding a space between the first side 900A and the second side 910B. In another embodiment (not shown), the housing may refer to a structure which includes part of the first side 910A, second side 910B, and third side 910C of FIG. 9. According to an embodiment, the first side 910A may be constructed of a front plate 902 (or a front cover) (e.g., a polymer plate or a glass plate having various coating layers) which is at least partially transparent. The second side 910B may be constructed of a rear plate 911 (or a rear cover) which may be opaque. For example, the rear plate 911 may be constructed, for example, and without limitation, of coated or colored glass, ceramic, polymer, metallic materials (e.g. aluminum, stainless steel (STS), or magnesium), a combination of at least two of these materials, or the like. The lateral side 910C (or a side member or side surface) may be constructed of a lateral bezel structure (or a lateral member) 918 bonded to the front plate 902 and the rear plate 911 and including, for example, and without limitation, metal and/or polymer. In some embodiments, the rear plate 911 and the lateral bezel structure 918 may be constructed integrally and may include the same material (e.g., a metallic material such as aluminum).

According to an embodiment, the electronic device 900 may include, for example, and without limitation, at least one or more of a display 901, an input device 903, audio output devices 907, and 914, sensor modules 904, 919, camera modules 905, 912, and 913, and key input devices 915, 916 and 917, an indicator 906, and connector holes 908 and 909. In various example embodiments, the electronic device 900 may omit at least one (e.g., the key input devices 915, 916 and 917 or the indicator 906) of these components or may additionally include other components.

The display 901 may be exposed through, for example, some portions of the front plate 902. In an example embodiment, A portion of the display 901 may be exposed through the front plate 902 forming the first side 910A and the first region 910D of the lateral side 910C. The display 901 may be disposed adjacent to or bonded to, for example, and without limitation, a touch sensing circuit, a pressure sensor capable of measuring touch strength (pressure), and/or a digitizer for detecting a stylus pen of a magnetic field type. In an example embodiment, at least portion of the sensor modules 904, 919 and/or at least portion of the key input devices are disposed on the first portion 910D and/or the second portion 910E.

The audio modules 903, 907, and 914 may include a microphone hole 903 and speaker holes 907 and 914. A microphone for acquiring external sound may be disposed inside the microphone hole 903. In some embodiments, a plurality of microphones may be disposed to sense a direction of the sound. The speaker holes 907 and 914 may include the external speaker hole 907 and the receiver hole 914 for a call. In some embodiments, the speaker holes 907 and 914 and the microphone hole 903 may be implemented as a single hole, or a speaker (e.g., a piezo speaker) may be included without the speaker holes 907 and 914.

The sensor modules 904 and 919 may generate an electrical signal or data value corresponding to an internal operating state of the electronic device 900 or an external environmental state. The sensor modules 904 and 919 may include, for example, the first sensor module 904 (e.g., a proximity sensor) and/or second sensor module (not shown) (e.g., a fingerprint sensor) disposed to the first side 910A of the housing 910, and/or the third sensor module 919 (e.g., an HRM sensor) disposed to the second side 910B of the housing 910. The fingerprint sensor may be disposed to a portion of the first side 910A (e.g., a home key button 915) or the second side 910B of the housing or below the display 901. The electronic device 900 may further include at least one of a sensor module (not shown), for example, and without limitation, a gesture sensor, a gyro sensor, an atmospheric pressure sensor, a magnetic sensor, an acceleration sensor, a grip sensor, a color sensor, an Infrared (IR) sensor, a biometric sensor, a temperature sensor, a humidity sensor, an illumination sensor 904, or the like.

The camera modules 905, 912, and 913 may include the first camera device 905 disposed to the first side 910A of the electronic device 900, the second camera device 912 disposed to the second side 910B, and/or the flash 913. The camera modules 905 and 912 may include one or more lenses, an image sensor, and/or an image signal processor. The flash 913 may include, for example, and without limitation, a Light Emitting Diode (LED), a xenon lamp, or the like. In some embodiments, two or more lenses (wide angle and telephoto lenses) and image sensors may be disposed to one side of the electronic device 900.

The key input devices 915, 916, and 917 may include the home key button 915 disposed to the first side 910A of the housing 910, the touch pad 916 disposed around the home key button 915, and/or the side key button 917 disposed to the lateral side 910C of the housing 910. In another embodiment, the electronic device 900 may not include some or all of the aforementioned key input devices 915, 916, and 917. The key input devices 915, 916, and 917, which are not included, may be implemented using a soft key displayed on the display 901 or a in a pressure sensor included in the display 901.

The indicator 906 may be disposed on, for example, the first face 910A of the housing 910. The indicator 906 may include the state information of the electronic device 900 in an optical form, and may include an LED.

The connector holes 908 and 909 may include the first connector hole 908 capable of accommodating a connector (e.g., a USB connector) for transmitting/receiving power and/or data of an external electronic device and/or the second connector hole or earphone jack 909 capable of accommodating a connector for transmitting/receiving an audio signal with respect to the external electronic device. According to an embodiment, the socket connector installed in the first connector hole 908 may be the socket connector 100 of FIG. 1. According to an embodiment, the socket connector may include a shell (or a housing) (e.g., the housing 110 in FIG. 1B) including an opening, a tongue (e.g., the tongue 120 in FIG. 1B) disposed in a space in the shell, and a plurality of terminals (e.g., the terminals 241 in FIG. 1B) disposed on at least one of the top surface or the bottom surface of a non-conductive first plate (e.g., the first plate 220 in FIG. 1B) of the tongue. The opening in the socket connector (e.g., the opening 110*b* in FIG. 1A) may be aligned with a connector hole 908, and the header connector (e.g., the header connector 190 in FIG. 1A or the header connector 400 in FIG. 4) may be inserted into the shell 110 of the socket connector through the first connector hole 908.

When the header connector is coupled to the socket connector, a plurality of terminals of the tongue can be electrically connected to a plurality of terminals of the header connector.

The tongue (e.g., the tongue 120 in FIG. 1A, the tongue 700 in FIG. 7A, or the tongue 800 in FIG. 8A) of the socket connector (e.g., the socket connector 100 in FIG. 1A) may include a non-conductive first plate (e.g., the first plate 220 in FIG. 1B, the first plate 720 in FIG. 7A, or the first plate 820 in FIG. 8A) and a conductive second plate (e.g., the second plate 250 in FIG. 1B, the second plate 750 in FIG. 7A, or the second plate 850 in FIG. 8A), which has at least a portion disposed inside the non-conductive first plate 220, 720, or 820. According to an embodiment, the second plate 250, 750, or 850 may be designed to have a strength (e.g., tensile strength, flexural strength, shear strength, compressive strength, fatigue strength, or the like) greater than that of the first plate 220, 720, or 820 so as to increase the endurance of the tongue 120, 700, or 800. The conductive second plate 250, 750 or 850 may be physically separated from a plurality of terminals (e.g., the terminals 241 in FIG. 1B, the terminals 741 in FIG. 7A, or the terminals 841 in FIG. 8A), and may be electrically connected to a ground of an electronic device 1100. According to an embodiment, the second plate 250, 750, or 850 of the tongue 120, 700, or 800 may include a plurality of protruding portions (e.g., the protruding portion 251 in FIG. 1B, the protruding portion 751 in FIG. 7A, or the protruding portion 851 in FIG. 8A) protruding further than the terminals 241, 741, or 841 toward the opening (e.g., the first opening 110*b* in FIG. 1A) in the shell (e.g., the housing 110 in FIG. 1A), into which the header connector (e.g., the header connector 190 in FIG. 1A or the header connector 400 in FIG. 4) can be inserted, and the protruding portion 251, 751, or 851 may be designed in the form bent toward the top surface or the bottom surface of the non-conductive first plate 220. The bent end portion 251, 751, or 851 of the second plate 250 may prevent the non-conductive first plate 220, 720, or 820 and/or the terminals 251, 751, or 851 from being damaged by an external object inserted into the socket connector.

The terminals (e.g., the terminals 241 in FIG. 1A) of the socket connector (e.g., the socket connector 100 in FIG. 1A) may be electrically connected to a control circuit such as a processor mounted in the electronic device 900. According to an embodiment, the control circuit may include a power management unit (PMU) (not illustrated). For example, the PMU may control the power supply to minimize power consumption according to the operation of the control circuit. The PMU may control a charge operation based on the charged state of a battery or the like. The PMU may control power transmission/reception operation of an external device connected to the socket connector through a Vbus terminal, a CC terminal, or the like of the socket connector.

According to an embodiment, the control circuit may transmit a USB data signal (e.g., USB D+ or USB D−) to a USB controller through a socket connector (e.g., the socket connector 100 in FIG. 1A). In another example, the control circuit may transmit a signal for controlling the operation of the USB controller. For example, when the kind of an external device connected through the socket connector is identified, the control circuit may transmit a signal that causes a signal suitable for the identified external device (or the kind of the external device) to be transmitted, to the USB controller.

According to an embodiment, the control circuit may be designed to include a USB controller. For example, the USB controller may detect whether an external device is connected, the operation mode of an electronic device, or the kind of the connected external device based at least on a signal received through a plurality of terminals (e.g., the terminals 241 in FIG. 1A) of a socket connector (e.g., the socket connector 100 in FIG. 1A).

According to an embodiment, the USB controller may acquire information included in a channel configuration (CC) signal received from a CC terminal of a socket connector (e.g., the socket connector 100 in FIG. 1A) (e.g., information on impedance of a pull-down resistance (or voltage measured based on the pull-down resistance), voltage measured at an open state, or resistance occurring by a cable, and may detect whether an external device is connected, the operation mode of the electronic device 900, or the kind of the connected external device 501, based at least on such information.

According to an embodiment, the USB controller may detect the kind of an external device connected to the electronic device 900, based at least on a sideband use (SBU) signal received from an SBU terminal of a socket connector (e.g., the socket connector 100 in FIG. 1). The USB controller may detect the kind of the external device connected to the electronic device 900 by identifying the ID of the external device (or an ID impedance value of the external device) included in the SBU signal.

According to an embodiment, the USB controller may include a communication integrated circuit (IC), and may detect the kind of the external device connected to the electronic device 900 when the communication IC performs communication with the external device via the SBU terminal of the socket connector. For example, the communication IC may transmit/receive a signal that includes at least one of the audio output scheme, the kind, the vendor of the external device, or the unique number of the external device via the SBU terminal of the socket connector. In another example, the communication IC may authenticate the vendor by performing communication with an external device through the SBU terminal of the socket connector.

Referring to FIG. 11, an electronic device 1100 (e.g., the electronic device (900) of FIG. 9 or FIG. 10) may include a lateral bezel structure 1110, a first support member 1111 (e.g., a bracket), a front plate 1120, a display 1130, a printed circuit board 1140, a battery 1150, a second support member 1160 (e.g., a rear case), an antenna 1170, and a rear plate 1180. In some embodiments, the electronic device 1100 may omit at least one (e.g., the first support member 1111) of these components, or may additionally include other components. At least one of the components of the electronic device 1100 may be the same as or similar to at least one of the components of the electronic device 900 of FIG. 9 or FIG. 10, and redundant descriptions will not be repeated here.

The first support member 1111 may be coupled with the lateral bezel structure 1110 by being disposed inside the electronic device 1100 or may be constructed integrally with respect to the lateral bezel structure 1110. The first support member 1111 may be constructed of, for example, and without limitation, a metal material and/or non-metal material (e.g., polymer), or the like. The display 1130 may be bonded to one side of the first support member 1111, and the printed circuit board 1140 may be bonded to the other side thereof. A processor, a memory, and/or an interface may be mounted on the printed circuit board 1140. The processor may include various processing circuitry, such as, for example, and without limitation, one or more of a central processing unit, an application processor, a graphic processing unit, an image signal processor, a sensor hub processor, a communication processor, or the like.

The memory may include, for example, a volatile memory or a non-volatile memory.

The interface may include, for example, and without limitation, a High Definition Multimedia Interface (HDMI), a Universal Serial Bus (USB) interface, a Secure Digital (SD) card interface, an audio interface, or the like. For example, the interface may electrically or physically couple the electronic device 1100 and the external electronic device, and may include a USB connector, an SD card/MMC connector, or an audio connector.

As a device for supplying power to at least one component of the electronic device 1100, the battery 1150 may include, for example, and without limitation, a non-rechargeable primary cell, a rechargeable secondary cell, a fuel cell, or the like. At least one portion of the battery 1150 may be disposed on the same plane substantially with respect to, for example, the printed circuit board 1140. The battery 1150 may be disposed integrally inside the electronic device 900, or may be detachably disposed with respect to the electronic device 1100.

The second support member 1160 is coupled to the first support member 1111 and may be disposed between the printed circuit board 1140 and the back plate 1180. The second support member 1160 is coupled to the first support member 1111 using a bolt fastening, etc. together with the printed circuit board 1140, and may serve to cover and protect the printed circuit board 1140.

The antenna 1170 may be disposed between the rear plate 1180 and the battery 1150. The antenna 1170 may include, for example, and without limitation, a Near Field Communication (NFC) antenna, a wireless charging antenna, a Magnetic Secure Transmission (MST) antenna, or the like. The antenna 1170 may perform short-range communication, for example, with the external electronic device, or may wirelessly transmit/receive the power required for charging. In another embodiment, an antenna structure may be constructed by at least part of the lateral bezel structure 1110 and/or the first support member 1111 or a combination thereof.

A side bezel structure 1110 may include an opening 11101 (e.g., the first connector hole 908 in FIG. 9), and a socket connector (e.g., the socket connector 100 in FIG. 1A) may be disposed inside the opening 11101 or may be mounted to be aligned with the opening 11101.

Figure 12:
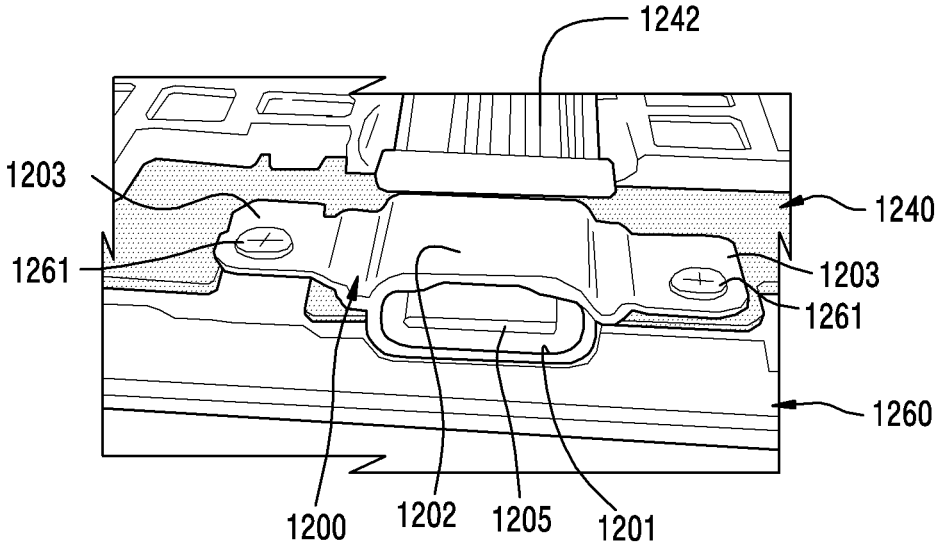
FIG. 12 illustrates the state in which a socket connector according to an embodiment is mounted on an electronic device.

FIG. 12 illustrates the state in which a socket connector according to an embodiment is mounted on an electronic device. Referring to FIG. 12, a socket connector 1200 may be mounted on a printed circuit board 1240. According to an embodiment, the printed circuit board 1240 in FIG. 12 may be separated from the printed circuit board 1140 in FIG. 11, and the printed circuit boards 1140 and 1240 may be electrically connected to each other via a connection member (e.g., a flexible printed circuit board (FPCB)) 1242. In some embodiments, the printed circuit board 1140 in FIG. 11 may be designed to include the printed circuit board 1240 in FIG. 12. According to an embodiment, the socket connector 1200 and the printed circuit board 1240 may be coupled to a support member 1260 (e.g., the first support member 1111 in FIG. 11) using bolts 1261. According to an embodiment, the socket connector 1200 may include a shell 1202 including an opening 1201 and extensions 1203 extending to opposite sides of the shell 1202. The extensions 1203 are portions to which the bolts 1261 are fastened, and may include holes (not illustrated) penetrated by the bolts 1261. For bolt fastening, the printed circuit board 1240 may include holes (not illustrated) aligned with the holes in the extensions 1203. For bolt fastening, the support member 1260 may include a bolt-fastening boss (not illustrated) aligned with the holes in the extensions 1203. According to an embodiment, the socket connector 1200 may include a tongue 1205 disposed in a space of the shell 1202 and a plurality of terminals disposed on at least one of the top surface and the bottom surface of a non-conductive first plate of the tongue 1205. The opening 1201 in the socket connector 1200 may be aligned with the connector hole 908 (or the opening 11101 in FIG. 11), and the header connector (e.g., 400 in FIG. 4) may be inserted into the shell 1202 of the socket connector 1200 through the connector hole 908. When the header connector is coupled to the socket connector 1200, the terminals of the tongue 1205 may be electrically connected to the terminals of the header connector. The tongue 1205 (e.g., the tongue 120 in FIG. 1A, the tongue 700 in FIG. 7A, or the tongue 800 in FIG. 8A) of the socket connector 1200 may include a non-conductive first plate (e.g., the first plate 220 in FIG. 1B, the first plate 720 in FIG. 7A, or the first plate 820 in FIG. 8A) and a conductive second plate (e.g., the second plate 250 in FIG. 1B, the second plate 750 in FIG. 7A, or the second plate 850 in FIG. 8A), which has at least a portion disposed inside the non-conductive first plate 220, 720, or 820. The second plate 250, 750 or 850 may be physically separated from a plurality of terminals (e.g., the terminals 241 in FIG. 1B, the terminals 741 in FIG. 7A, or the terminals 841 in FIG. 8A), and may be electrically connected to a ground of the printed circuit board 1240. According to an embodiment, the second plate 250, 750, or 850 may be designed to have a strength (e.g., tensile strength, flexural strength, shear strength, compressive strength, fatigue strength, or the like) greater than that of the first plate 220, 720, or 820 so as to increase the endurance of the tongue 1205. According to an embodiment, the conductive second plate 250, 750, or 850 of the tongue 1205 may include a plurality of protruding portions (e.g., the protruding portion 251 in FIG. 1B, the protruding portion 751 in FIG. 7A, or the protruding portion 851 in FIG. 8A) protruding further than the terminals 241, 741 or 841 toward the opening 1201 (e.g., the second opening 110*b* in FIG. 1A) in the shell 1202 (e.g., the housing 110 in FIG. 1A), into which the header connector (e.g., the header connector 190 in FIG. 1A or the header connector 400 in FIG. 4) can be inserted, and the protruding portion 251, 751, or 851 may be designed in the form bent toward the top surface or the bottom surface of the non-conductive first plate 220, 720, or 820. The bent end portion 251, 751, or 851 of the conductive second plate 250, 750, or 850 may prevent the first plate 220, 720, or 820 and/or the terminals 241, 741, or 841 from being damaged by an external object inserted into the socket connector 1200.

Figure 13:
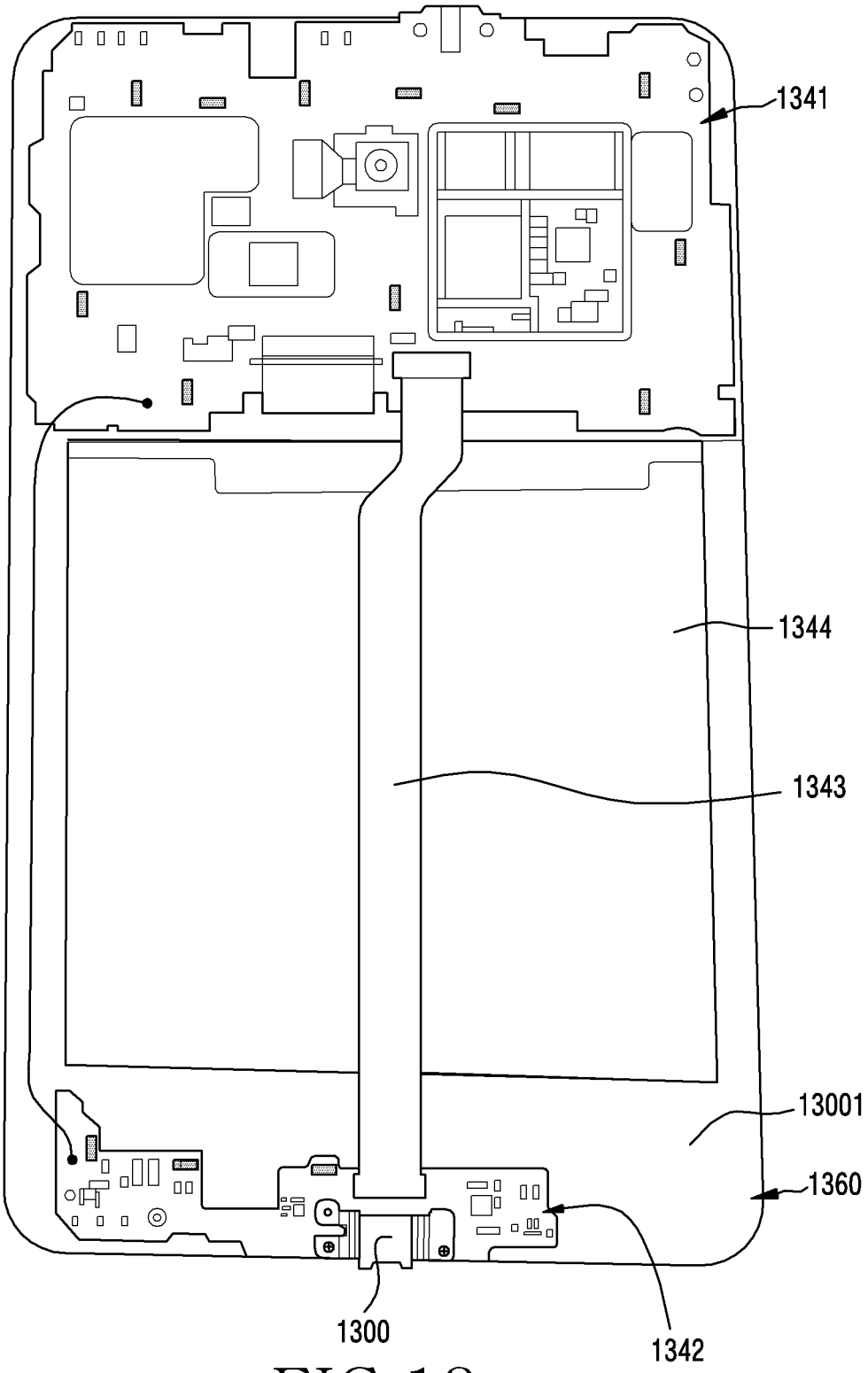
FIG. 13 is a view illustrating the state in which a printed circuit board is coupled to a support member according to an embodiment.

FIG. 13 is a view illustrating the state in which a printed circuit board is coupled to a support member according to an embodiment. Referring to FIG. 13, a first printed circuit board 1341 (e.g., the printed circuit board 1140 in FIG. 11) and a second printed circuit board 1342 (e.g., the printed circuit board 1240 in FIG. 12) may be coupled to a surface 13001 of a support member 1360 (e.g., the first support member 1111 in FIG. 11) facing a rear plate (e.g., the rear plate 1180 in FIG. 11). According to an embodiment, the support member 1360 has a rectangular shape, and the first printed circuit board 1341 and the second printed circuit board 1342 may be disposed to be separated from each other in the longitudinal direction. A flexible printed circuit board (FPCB) 1343 (e.g., the connection member 1242 in FIG. 12) may electrically connect the first printed circuit board 1321 and the second printed circuit board 1342. A battery (e.g., the battery 1150 in FIG. 11) may be disposed in a space 1344 between the first printed circuit board 1341 and the second printed circuit board 1342. According to an embodiment, the socket connector 1300 (e.g., the socket connector 1200 of FIG. 12) may be mounted on the second printed circuit board 1342.

According to various embodiments, the electronic device may further include various elements (or modules) according to the provided type thereof. These constituent elements are modified very diversely according to the convergence tendency of digital devices, and thus it is impossible to list all of the constituent elements. However, constituent elements equivalent to those mentioned above may be additionally included in the electronic device. Of course, in the electronic device according to various embodiments, certain constituent elements may be omitted from the above-mentioned constituent elements or may be replaced by other constituent elements according to the provided type of the electronic device.

An electronic device according to various embodiments disclosed herein may be any of various types of devices. The electronic device may include at least one of, for example, a portable communication device (e.g., a smartphone), a computer device, a portable multimedia device, a portable medical device, a camera, a wearable device, or a home appliance. The electronic device according to an embodiment disclosed herein is not limited to the above-described devices.

In various embodiments, the wearable device may include at least one of an accessory-type wearable device (e.g., a watch, a ring, a bracelet, an ankle bracelet, a necklace, spectacles, a contact lens, or a head-mounted device (HMD)), a fabric or clothing-integrated type wearable device (e.g., an electronic cloth), a body attachment type wearable device (e.g., a skin pad or tattoo), or a bio-implantable circuit. In some embodiments, the electronic device may include at least one of, for example, a television, a digital video disc (DVD) player, an audio device, a refrigerator, an air conditioner, a cleaner, an oven, a microwave, a washing machine, an air purifier, a set-top box, a home automation control panel, a security control panel, a media box (e.g., Samsung HomeSync™, Apple TV™, or Google TV™), a game console (e.g., Xbox™, or PlayStation™), an electronic dictionary, an electronic key, a camcorder, or an electronic picture frame.

In various embodiments, the electronic device may include at least one of various medical devices (e.g., various potable medical measurement devices (a blood glucose monitor, a heart rate monitor, a blood pressure monitor, or a clinical thermometer), a magnetic resonance angiography (MRA) device, a magnetic resonance imaging (MRI) device, a computed tomography (CT) device, a moving picture camera, or an ultrasonic device), a navigation system, a global navigation satellite system (GNSS), an event data recorder (EDR), a flight data recorder (FDR), an automobile infotainment device, a ship electronic device (e.g., a ship navigation system or a gyro compass), an avionics device, a security device, a vehicle head unit, an industrial or home robot, a drone, an automated teller machine (ATM) of a banking institution, a point of sales (POS) system of a store, or IoT devices (e.g., a bulb, various sensors, a sprinkler device, a fire alarm, a thermostat, a street lamp, a toaster, exercise equipment, a hot water tank, a heater, and a boiler). According to some embodiments, the electronic device may include at least one of furniture, part of a building/structure or an automobile, an electronic board, an electronic-signature-receiving device, a projector, and various measuring instruments (e.g., a water supply, or an electricity, gas, or electromagnetic wave measurement instrument). In various embodiments, the electronic device may be flexible or may be a combination of two or more of various devices described above. The electronic device according to an embodiment disclosed herein is not limited to the above-described devices. Herein, the term "user" may refer to a person who uses an electronic device or a device that uses an electronic device (e.g., an artificial intelligence electronic device).

According to an embodiment of the disclosure, an electronic device 900 may include a processor and a socket connector 100, and the socket connector 100 may include a housing 110 including a first opening 110*a*, a second opening 110*b*, and an inner space 111 between the first opening 110*a* and the second opening 110*b*, and a connection part 120 coupled to the first opening 110*a*. The connection part 120 may include: a first plate 220 including a top surface 2201 on which one or more first terminals 241*a* electrically connected to the processor are disposed and a bottom surface 2202 on which one or more second terminals 241*b* electrically connected to the processor are disposed, the first plate 220 being formed as a non-conductive member in at least a partial region of the inner space; and a second plate 250 disposed between at least a portion of the top surface 2201 and at least a portion of the bottom surface 2202. The second plate 250 may include a portion 251 protruding further than the one or more first terminals 241*a* or the one or more second terminals 241*b* toward the second opening 110*b* into which a header connector is capable of being inserted, and at least a portion of the protruding portion 251 is bent toward at least one of the top surface 2201 and the bottom surface 2202.

According to an embodiment of the disclosure, the second plate 250 may have a tensile strength greater than that of the first plate 220.

According to an embodiment of the disclosure, the second plate 250 may be formed of a metal material.

According to an embodiment of the disclosure, the second plate 250 may be electrically connected to the ground of the printed circuit board 900.

According to an embodiment of the disclosure, the second plate 250 may include portions C1 and C2 exposed to the side surface 12003 of the first plate 220 and electrically connected to the header connector.

According to an embodiment of the disclosure, the protruding portion 251 of the second plate 250 may include a structure in which a first end portion 252 bent to the top surface 2201 and a second end portion 253 bent to the bottom surface 2202 are alternated.

According to an embodiment of the disclosure, the protruding portion 251 of the second plate 250 may be bent at an angle of about 90 degrees with respect to a flat portion 254 of the second plate 250 toward the top surface 2201 or the bottom surface 2202.

According to an embodiment of the disclosure, the second plate 250 may include curved portions 252*b* and 253*b* between the protruding portion 251 and the flat portion 254.

According to an embodiment of the disclosure, the second plate 250 may include a plurality of physically separated portions (e.g., A plate 850*a*, B plate 850*b*, and C plate 850*c*).

According to an embodiment of the disclosure, among the one or more first terminals 241*a* and the one or more second terminals 241*b*, terminals configured to support power supply (e.g., A4, A9, B4, and B9 in FIG. 2C) may be aligned in a gap between the physically separated portions of the second plate 250 (e.g., the A plate 850*a*, the B plate 850*b*, and the C plate 850*c*).

According to an embodiment of the disclosure, the housing 110 may include a conductive material, and may be electrically connected to a ground of the electronic device 900.

According to an embodiment of the disclosure, the socket connector 100 may be a type-C socket connector.

According to various embodiments of the disclosure, the socket connector 100 may include a first opening 110*a*, a second opening 110*b*, and an inner space 111 between the first opening 110*a* and the second opening 110*b*, and a connection part 120 coupled to the first opening 110*a*. The connection part 120 may include: a first plate 220 including a top surface 2201 on which one or more first terminals 241*a* are disposed and a bottom surface 2202 on which one or more second terminals 241*b* are disposed, the first plate 220 being formed as a non-conductive member in at least a partial region of the inner space; and a second plate 250 disposed between at least a portion of the top surface 2201 and at least a portion of the bottom surface 2202. The second plate 250 may include a portion 251 protruding further than the one or more first terminals 241*a* or the one or more second terminals 241*b* toward the second opening 110*b* into which a header connector is capable of being inserted, and the protruding portion 251 is bent toward at least one of the top surface 2201 and the bottom surface 2202.

According to various embodiments of the disclosure, the second plate 250 may have a strength greater than that of the first plate.

According to various embodiments of the disclosure, the second plate 250 may be formed of a metal material.

According to various embodiments of the disclosure, the protruding portion 251 of the second plate may include a structure in which a first end portion 252 bent toward the top surface 2201 and a second end portion 253 bent toward the bottom surface 2202 are alternated.

According to various embodiments of the disclosure, the socket connector 100 may include a housing 110 having an opening 110*b* and an inner space 111 inside the opening 110*b*, and a connection part 120 disposed in the inner space 111 of the housing 110. The connection part 120 may include: a first plate 220 including a top surface 2201 on which one or more first terminals 241*a* are disposed and a bottom surface 2202 on which one or more second terminals 241*b* are disposed, the first plate 220 being formed as a non-conductive member in at least a partial region of the inner space 111; and a second plate 250 disposed between at least a portion of the top surface 2201 and at least a portion of the bottom surface 2202. The second plate 250 may include a portion 251 protruding further than the one or more first terminals 241*a* or the one or more second terminals 241*b* toward the opening 110*b* into which a header connector is capable of being inserted, and the protruding portion 251 is bent toward at least one of the top surface 2201 and the bottom surface 2202.

According to various embodiments of the disclosure, the second plate 250 may have a tensile strength greater than that of the first plate 220.

According to various embodiments of the disclosure, the second plate 250 may be formed of a metal material.

According to various embodiments of the disclosure, the protruding portion 251 of the second plate 250 may include a structure in which a first end portion 252 bent toward the top surface 2201 and a second end portion 253 bent toward the bottom surface 2202 are alternated.

The disclosure has been described above with reference to preferred embodiments thereof. A person ordinarily skilled in the art to which the disclosure belongs would understand that the disclosure can be implemented in a modified form without departing from the essential characteristics of the disclosure. Therefore, the embodiments disclosed herein should be considered from a descriptive viewpoint, rather than from a restrictive viewpoint. The scope of the disclosure is represented in the following claims rather than in the foregoing description, and all differences within the scope equivalent thereto should be construed as being included in the scope of the disclosure.

The invention claimed is:

1. An electronic device comprising:

a processor; and a socket connector, wherein the socket connector comprises:

a housing including a first opening, a second opening, and an inner space between the first opening and the second opening; and a connection part coupled to the first opening, wherein the connection part comprises:

a first plate including a top surface on which one or more first terminals electrically connected to the processor are disposed and a bottom surface on which one or more second terminals electrically connected to the processor are disposed, the first plate being formed as a non-conductive member in at least a partial region of the inner space; and a second plate disposed between at least a portion of the top surface and at least a portion of the bottom surface, wherein the second plate includes a portion protruding further than the one or more first terminals or the one or more second terminals toward the second opening into which a header connector is capable of being inserted, and the protruding portion is bent toward at least one of the top surface and the bottom surface.

2. The electronic device of claim 1, wherein the second plate has a tensile strength greater than that of the first plate.

3. The electronic device of claim 1, wherein the second plate is formed of a metal material.

4. The electronic device of claim 3, wherein the second plate is electrically connected to a ground of the electronic device.

5. The electronic device of claim 3, wherein the second plate includes a portion exposed to a side surface of the first plate and electrically connected to the header connector.

6. The electronic device of claim 1, wherein the protruding portion of the second plate includes a structure in which a first end portion bent to the top surface and a second end portion bent to the bottom surface are alternated.

7. The electronic device of claim 1, wherein the protruding portion of the second plate is bent at an angle of 90 degrees with respect to a flat portion of the second plate toward the top surface and the bottom surface.

8. The electronic device of claim 7, wherein the second plate includes a curved portion between the protruding portion and the flat portion.

9. The electronic device of claim 1, wherein the second plate includes multiple portions that are physically separated from each other.

10. The electronic device of claim 9, wherein, among the one or more first terminals and the one or more second terminals, terminals configured to support power supply are aligned in a gap between the multiple physically separated portions of the second plate.

11. The electronic device of claim 1, wherein the housing includes a conductive material, and is electrically connected to a ground of the electronic device.

12. The electronic device of claim 1, wherein the socket connector is a type-C socket connector.

13. The electronic device of claim 1, further comprising:

a printed circuit board on which the processor and the socket connector are mounted.

14. The electronic device of claim 13, wherein tails extending from the first terminals are electrically connected to a plurality of lands disposed on one surface of the printed circuit board.

15. The electronic device of claim 4, wherein at least one tail extending from the second plate is electrically connected to at least one land disposed on one surface of the printed circuit board.

* * * * *